US006524762B2

(12) United States Patent
Tsutsui et al.

(10) Patent No.: US 6,524,762 B2
(45) Date of Patent: Feb. 25, 2003

(54) MONO-COMPONENT DEVELOPING DEVICE, TONER FOR THE SAME AND IMAGE FORMING APPARATUS

(75) Inventors: Chikara Tsutsui, Nishinomiya (JP); Katsunori Kurose, Amagasaki (JP); Masahiro Anno, Sakai (JP); Minoru Nakamura, Takarazuka (JP); Masahide Inoue, Suita (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/874,291

(22) Filed: Jun. 6, 2001

(65) Prior Publication Data

US 2002/0012551 A1 Jan. 31, 2002

(30) Foreign Application Priority Data

Jun. 16, 2000 (JP) ..... 2000-181653

(51) Int. Cl.[7] ..... G03G 15/08
(52) U.S. Cl. ..... 430/108.8; 399/252; 399/281
(58) Field of Search ..... 399/252, 281; 430/108.8

(56) References Cited

U.S. PATENT DOCUMENTS

| | | | | |
|---|---|---|---|---|
| 5,139,914 A | | 8/1992 | Tomiyama et al. | |
| 5,422,214 A | * | 6/1995 | Akiyama et al. | 430/106.6 |
| 5,565,293 A | | 10/1996 | Akiyama et al. | |
| 5,759,731 A | | 6/1998 | Hagi et al. | |
| 5,797,075 A | | 8/1998 | Saito et al. | |

FOREIGN PATENT DOCUMENTS

| | | |
|---|---|---|
| JP | 10-171226 | 6/1998 |

* cited by examiner

*Primary Examiner*—John Goodrow
(74) *Attorney, Agent, or Firm*—Morrison & Foerster LLP

(57) ABSTRACT

The present invention relates to a mono-component developing device, which develops an electrostatic latent image formed on an electrostatic latent image-supporting member with a toner having a weight-average particle size of from 4 to 10 $\mu$m, a compression rate of not more than 32% and an angle of repose of not more than 38°, and a toner used for the mono-component developing device. Even in the case when a comparatively great stress is imposed on the toner particles, the toner of the present invention maintains superior fluidity and makes it possible to provide a high-quality image.

22 Claims, 7 Drawing Sheets

(a)

(b)

MONO-COMPONENT DEVELOPING DEVICE, TONER FOR THE SAME AND IMAGE FORMING APPARATUS

This application is based on application No.2000-181653 filed in Japan, the contents of which are hereby incorporated by reference.

BACKGROUND OF THE INVENTION

1. Field of the Invention

The present invention relates to a non-magnetic mono-component developing device in an image-forming apparatus, such as a copying machine and a printer, and to a toner for such a device.

2. Description of the Related Art

Conventionally, with respect to a developing device used for an image-forming apparatus such as a copying machine and a printer, a two-component developing system using a two-component developing agent containing toner and carrier and a mono-component developing system using a mono-component developing agent containing only toner have been known. Of these two developing systems, it has been known that the mono-component developing system is more suitable in order to meet recent demands for compact image-forming apparatuses. In particular, in the case of color image-forming apparatuses having a plurality of developing devices for housing toners of a plurality of colors, it is more essential to make developing devices more compact.

In a color image-forming apparatus having developing devices of the mono-component developing system, in each of the developing devices, in general, toner charged by a regulating member is transported by a toner-supporting member to a developing area facing an electrostatic latent image-supporting member, and after an electrostatic latent image on the electrostatic latent image-supporting member is developed by the toner to form a toner image, these toner images are superposed with or without using an intermediate transfer member, and transferred on a sheet of recording paper and fixed thereon. In order to make such a color image-forming apparatus more compact, it is sometimes necessary to move the electrostatic latent image-supporting member upward from below at the developing area.

In the case when the electrostatic latent image-supporting member is moved upwards from below at the developing area, from the viewpoint of high image quality, in the developing device, it is necessary to provide an arrangement in which: the toner-supporting member is moved upward from below at the developing area, a toner-supplying member for supplying toner to the toner-supporting member and the toner-supporting member are made to rotate in the same direction, and at a portion where the toner-supplying member and the toner-supporting member come into contact with each other, the toner-supplying member and the toner-supporting member are allowed to move in opposite directions from each other (see U.S. Pat. No. 5,797,075 and Japanese Patent Application Laid-Open No. Hei 10-171226 (1998)).

However, when a known toner is applied to the above-mentioned image-forming apparatus, a comparatively great stress is imposed on the toner particles, resulting in a problem of degradation in the toner fluidity. The degradation in the fluidity causes less amount of toner to be transported to the developing area by the toner-supporting member, or unevenness in the thickness of the toner layer formed on the toner-supporting member; and the resulting problems are a reduction in the density in the copy image and deterioration in the gradation of the copy image, and, in particular, in the case of a solid image, unevenness in density and cloud tends to occur.

SUMMARY OF THE INVENTION

The present invention is to solve above problems of the mono-component developing device in an image-forming apparatus.

Such a problem is solved by using a mono-component developing toner having a weight-average particle size of from 4 to 10 $\mu$m, a compression rate of not more than 32% and an angle of repose of not more than 38°.

DETAILED DESCRIPTION OF THE INVENTION

The present invention relates to a non-magnetic mono-component developing device, which develops an electrostatic latent image formed on an image-supporting member with a toner, comprising:

a toner-supporting member that is placed face to face with the image-supporting member, the surface of said toner-supporting member and the surface of said image-supporting member moving upwards from below at a developing area in which said toner-supporting member and said image-supporting member are placed face to face with each other;

a toner housing chamber for housing a toner having a weight-average particle size of from 4 to 10 $\mu$m, a compression rate of not more than 32% and an angle of repose of not more than 38°; and a toner-supplying member for supplying the toner housed in the toner housing chamber to said toner-supporting member, said toner-supplying member being placed face to face with said toner-supporting member, the surface of said toner-supplying member and the surface of said toner-supporting member being allowed to move in opposite directions from each other at the face to face area, and to a toner used in the non-magnetic mono-component developing device.

The toner used in the present invention can maintain superior fluidity even under a comparatively great stress imposed on the toner particles, and consequently to provide a high-quality image.

Figure 1:
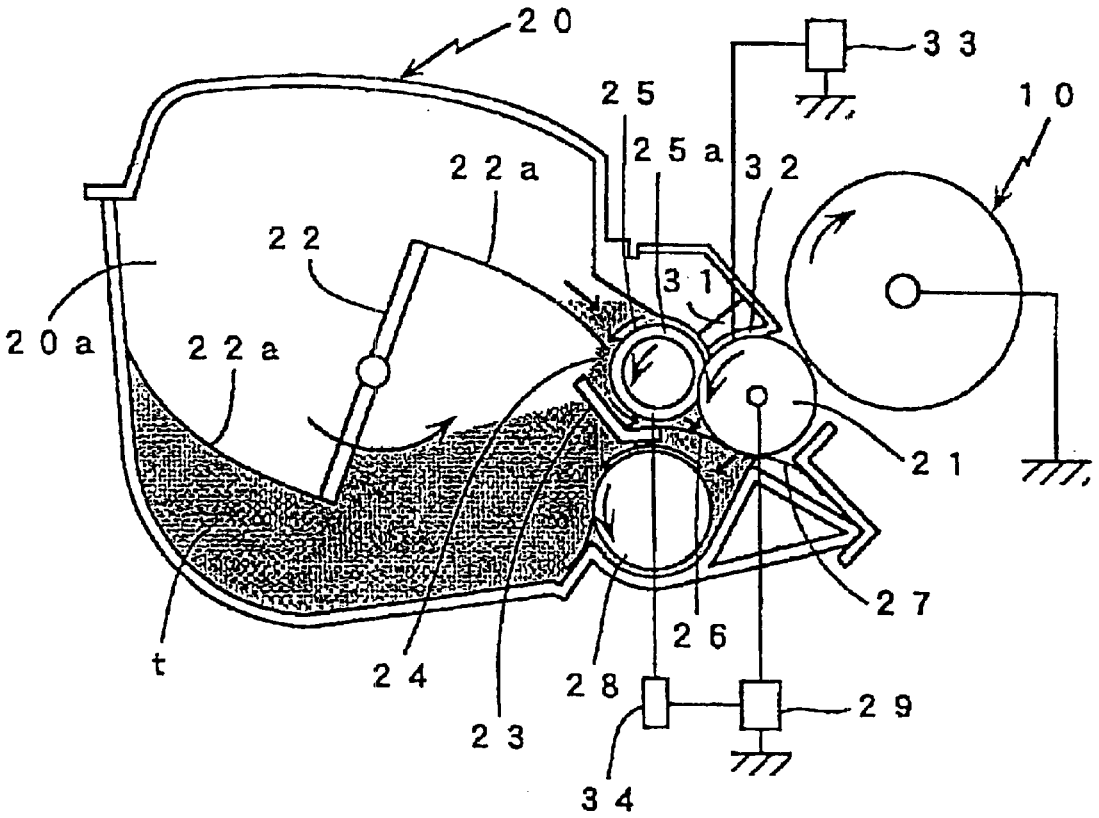
FIG. 1 is a schematic drawing that shows one example of the structure of a developing device to which a toner of the present invention is effectively applied.

One example of a developing device to which the toner of the present invention is effectively applied is explained by referring to FIG. 1. The developing device, schematically shown in FIG. 1, is characterized by an arrangement in which the toner-supporting member 21 and the electrostatic latent image-supporting member 10 move upwards from below at a developing area in which the toner-supporting member 10 and the electrostatic latent image-supporting member 21 are aligned face to face with each other, and at a portion where a toner-supplying member 25 for supplying toner t to the toner-supporting member 21 and the toner-supporting member 21 come into contact with each other, the toner-supplying member 25 and the toner-supporting member 21 are allowed to move in opposite directions from each other.

More specifically, in the developing device of FIG. 1, the toner-supporting member 21 is installed so as to face the electrostatic latent image-supporting member 10 with a slight distance between the two, and the toner-supporting member 21 and the electrostatic latent image-supporting member 10 are rotated in opposite directions from each other so that, at the developing area in which the toner-supporting member 21 and the electrostatic latent image-supporting member 10 are aligned face to face with each other, the toner-supporting member 21 and the electrostatic latent image-supporting member 10 are made to move upward from below respectively, while a developing bias voltage Vb1 is applied to the toner-supporting member 21 from a developing bias power supply 29. The distance (DS) between the toner-supporting member 21 and the electrostatic latent image-supporting member 10 is not particularly limited, however, in an attempt to effectively prevent unevenness of density and leak, it is preferably set in the range of from 0.05 to 0.2 mm.

In this developing device, the toner t is housed inside a housing section 20*a* of a device main body 20, and a toner feeding member 22 provided with blade member 22*a* is placed in a manner so as to rotate therein.

This toner feeding member 22 is rotated so that the toner t, housed inside the toner housing section 20*a,* is supplied to a toner-holding section 24 in which a receiving member 23 is installed, by the blade member 22*a* of the toner feeding member 22. The receiving member 23 is placed below the toner-supplying member 25. Although not particularly limited, the gap between the receiving member 23 and the toner-supplying member 25 is preferably set in a range from 0.2 to 0.8 mm in its shortest distance. By setting the gap in the above-mentioned range, the toner is allowed to shift more smoothly, thereby making it possible to obtain the effects of the present invention more efficiently.

A roller-shaped toner-supplying member 25, which has a conductive elastic layer 25*a* having a plurality of cells on the peripheral portion thereof, is installed in the toner holding section 24 holding the toner t, and the elastic layer 25*a* of the toner-supplying member 25 is pressed onto the toner-supporting member 21.

Then, the toner-supplying member 25 is rotated in the same direction as the toner-supporting member 21 so that at the portion where the toner-supplying member 25 and the toner-supporting member 21 come into contact with each other, the toner-supplying member 25 and the toner-supporting member 21 are allowed to move in opposite directions from each other, and a bias voltage Vb2, which is greater on the same polarity side as the charging polarity of the toner t than the developing bias voltage Vb1 applied to the toner-supporting member 21 from the developing bias power supply 29, is applied to the toner-supplying member 25 from a bias power supply 34; thus, the toner t in the toner holding section 24 is preliminarily charged to a predetermined polarity on the toner-supplying member 25, and supplied to the toner-supporting member 21. Thus, the toner t, which has been preliminarily charged, is held on the toner-supporting member 21 by an electrostatic force, and transported. Here, supposing that the peripheral speed of the toner-supporting member is S1 with the peripheral speed of the toner-supplying member being S2, although not particularly limited, the rate S2/S1 is preferably set in the range of from 0.4 to 2.8, more preferably from 0.9 to 1.9, from the viewpoint of further improvement in the follow-up properties of solid image.

One end of the pre-charging member 26 formed into a plate shape is attached to the receiving member 23, and this pre-charging member 26 is extended toward the downstream side in the rotation direction of the toner-supporting member 21 below the toner-supplying member 25 so that the other end (tip) portion of the pre-charging member 26 is made in contact with the toner supporting member 21 along its axis direction with an appropriate linear pressure at a position on the downstream side in the rotation direction of the toner-supporting member 21 from the toner-supplying member 25.

The toner t held on the toner-supporting member 21 is further preliminarily charged through the contact by the pre-charging member 26; therefore, the toner t, thus preliminarily charged, is held on the toner-supporting member 21, and transported.

At a lower portion of the toner-supporting member 21 on the downstream side in the rotation direction of the toner-supporting member 21 from the tip of the pre-charging member 26, an end of a regulating member 27 having a plate shape extended toward the upstream side in the rotation direction of the toner-supporting member 21 is made in contact with the toner-supporting member 21 with a proper gap from the tip of the pre-charging member 26, and the toner t, held on the toner-supporting member 21 by an electrostatic force as described above, is led to the regulating member 27. In this case, since the toner t is held on the toner-supporting member 21 by the electrostatic force as described above, it is possible to prevent the toner t from separating from the toner-supporting member 21 and falling by gravity before it has reached the regulating member 27, with the result that a sufficient amount of toner t is led to the position of the regulating member 27 by the toner-supporting member 21. Although not particularly limited, the gap between the tip of the regulating member 27 and the tip of the pre-charging member 26 is preferably set in the range of from 0.6 to 1.4 mm.

Then, excessive toner t is removed from the toner-supporting member 21 by the regulating member 27 so that the amount of toner t to be transported to the developing area is regulated, and the toner t is appropriately charged. The excessive toner t separated from the toner-supporting member 21 by the regulating member 27 is directed downward through the gap, and returned to the housing section 20*a* by a return roller 28 placed below.

The toner t, which is regulated by the regulating member 27 and appropriately charged as described above, is transported to the developing area facing the electrostatic latent image-supporting member 10 by the toner-supporting member 21, and at the developing area, the toner-supporting member 21 and the electrostatic latent image-supporting member 10 move upwards from below respectively, and the developing bias voltage Vb1, formed by multiplexing an AC voltage onto a DC voltage, is applied to the toner-supporting member 21 from the developing bias power supply 29 so that a vibration electric field is exerted between the toner-supporting member 21 and the electrostatic latent image-supporting member 10, while the toner t is being supplied from the toner-supporting member 21 onto an electrostatic latent image formed on the electrostatic latent image-supporting member 10, so as to carry out a developing process.

Not particularly limited, the frequency of the AC voltage forming the developing bias voltage Vb1 to be applied to the toner-supporting member 21 is preferably set in the range of 1000 to 3000 Hz, in an attempt to prevent unevenness in density more effectively and to further improve the gradation property.

With respect to the AC resistivity and DC resistivity of the toner-supporting member 21, although not particularly limited, the AC resistivity is preferably set in the range of from $2\times10^2$ to $5\times10^5\Omega$, and the DC resistivity is preferably set in the range of from $7.5\times10^4$ to $3\times10^7\Omega$ in an attempt to prevent unevenness in density and leakage more effectively.

After the electrostatic latent image formed on the electrostatic latent image-supporting member 10 is developed, the toner t remaining on the toner-supporting member 21 is returned to the device main body 20, and at a position from which the residual toner t on the toner-supporting member 21 is returned to the device main body 20, a seal member 32 is pressed onto the toner-supporting member 21 by a cushion member 31, while a voltage for eliminating. static electricity from the toner t is applied from a static eliminating power supply 33 to the seal member 32 so that the residual toner t on the toner-supporting member 21 is subjected to the static eliminating process.

After the residual toner t on the toner-supporting member 21 is subjected to the static eliminating process, the residual toner t remaining on the toner-supporting member 21 is removed from the toner-supporting member 21 by the toner-supplying member 25 that is allowed to move in a direction reversed to the toner-supporting member 21 at the portion contacting the toner-supporting member 21 as described earlier, and mixed with toner t in the toner holding section 24. Toner t is again supplied onto the toner-supporting member 21 from the toner-supplying member 25 as described earlier.

The toner of the present invention that is effectively applicable to the above-mentioned developing device is set to have a weight average particle size of from 4 to 10 $\mu$m, preferably from 5 to 9 $\mu$m, a compression rate of not more than 32%, preferably not more than 31%, and an angle of repose of not more than 38°, preferably from 29 to 37°.

The toner compression rate is one of indexes that indicate how easily the toner behavior is changed upon application of a pressure; and as the compression rate becomes smaller, the toner behavior becomes less susceptible to change upon application of a pressure. The toner compression rate exceeding 32% makes the toner behavior too susceptible to change upon application of a pressure (upon application of a stress), resulting in unevenness in density and degradation in the follow-up properties of solid image. In the case when the rotation of the driving section (the toner-supplying member and toner-supporting member) is high, the toner tends to cause clogging between the toner-supplying member and the toner-supporting member.

In the present specification, the toner compression rate is obtained by making measurements of the packed bulk density (PD) and the aerated bulk density (AD) by means of Powder Tester (made by Hosokawa Micron K.K.) to be calculating with the following formula:

$$\frac{\text{Packed bulk density (PD)} - \text{Aerated bulk density (AD)}}{\text{Packed bulk density (PD)}} \times 100$$

The toner angle of repose is one of the indexes that indicate the toner fluidity. As the angle of repose is smaller, the toner fluidity becomes higher (becomes higher in the degree of toner smoothness). The toner angle of repose exceeding 38° causes degradation in the toner passage property, resulting in unevenness in density and degradation in the follow-up properties of solid image.

In the present specification, the value of the toner angle of repose id the one obtained by using Powder Tester (made by Hosokawa Micron K.K.) is used.

The degree of surface smoothness (D/d50) of the toner of the present invention is preferably set to not less than 0.4, preferably in the range of from 0.4 to 0.8, more preferably from 0.45 to 0.70, most preferably from 0.45 to 0.65. Such a degree of surface smoothness makes it possible to demonstrate the effects of the present invention more effectively.

D/d50 is one of indexes that indicate the smoothness of the surface of a toner particle. As the value becomes closer to 1, it indicates that the smoothness of the particle surface becomes higher. The parameter D indicates a converted particle size ($\mu$m) from the BET specific surface area obtained when it is supposed that the toner shape is spherical, and is represented by expression: $6/(\rho\cdot s)$. the parameter $\rho$ is a true density (g/cm$^3$), the value of which is measured by an air-comparative specific gravity meter (made by Beckman Co., Ltd.). The parameter s is a BET specific surface area, the value of which is measured by Flowsorb 2300 (Shimadzu Seisakusho K.K.). The parameter d50 is a weight-average particle size (Hm) corresponding to 50% of the relative weight distribution classified by particle sizes.

The toner of the present invention is preferably set to have an aerated bulk density (AD value) of from 0.4 to 0.6 g/cm$^3$, preferably from 0.4 to 0.55 g/cm$^3$. Such an AD value makes it possible to efficiently provide the effects of the present invention. The AD value can be measured by using the same measuring method as the measuring method of the aerated bulk density (AD) in the above-mentioned toner compression rate.

Supposing that the peripheral velocity of the toner-supporting member is S1, the peripheral velocity of the toner-supplying member is S2 and the AD value of the toner is T, the toner of the present invention preferably satisfies the following relationship:

$$0.25 \leqq S2/S1\times T \leqq 1.26,$$

preferably, $$0.25 \leqq S2/S1\times T \leqq 1.155.$$

By satisfying such a relationship, it becomes possible to effectively prevent unevenness in density, and consequently to further improve the follow-up properties of solid image.

The above-mentioned toner of the present invention may be formed by known materials as long as it satisfies the above-mentioned weight average particle size, compression rate, and angle of repose, as well as D/d50, AD value and S2/S1×T if desired. The toner of the present invention is normally contains at least a binder resin and a coloring agent, with a releasing agent and a charge-control agent contained, if necessary.

With respect to the binder resin constituting the toner of the present invention, any known resin in the field of toner may be used; and examples thereof include polyester resins, vinyl resins, epoxy resins, styrene acrylic resins, polyether-polyol resins, etc. From the viewpoint of color-image formation, fixing property, anti-offset property and gloss-applying property, it is preferable to use polyester resins.

With respect to the polyester resin, polyester resins, obtained by polycondensating a polyhydric alcohol component and a polyhydric carboxylic acid component, may be used.

Among polyhydric alcohol components, examples of dihydric alcohol components include: bisphenol A alkylene oxide additives, such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane and polyoxyethylene(2,0)-2,2-bis(4-hydroxyphenyl)propane, ethyleneglycol, diethyleneglycol, triethyleneglycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethyleneglycol, polytetramethyleneglycol, bisphenol A, hydrogenized bisphenol A, etc.

Examples of trihydric or more alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among polyhydric carboxylic acid components, examples of dihydric carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenylsuccinic acid, isooctenyl succinic acid, n-octyl succinic acid, isooctyl succinic acid, and anhydrides of these acids or low alkyl esters.

Examples of trihydric or more carboxylic acid components include alkyl ester methacrylates, such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, a dimer of embole acid, anhydrides of these acids, and low alkyl esters.

In the present invention, with respect to the polyester resin, a material monomer for a polyester resin, a material monomer for a vinyl resin and a mixture with a monomer that reacts with both of the resin material monomers are used, and a polycondensating reaction for obtaining a polyester resin and a radical polymerization reaction for obtaining a vinyl resin are carried out in parallel in the same container; and resins thus obtained may be preferably used. Here, the monomer that reacts with both of the resin material monomers is, in other words, a monomer that can be used in both a polycondensating reaction and a radical polymerization reaction. That is, the monomer has a carboxyl group that undergoes a polycondensating reaction and a vinyl group that undergoes a radical polymerization reaction; and examples thereof include fumaric acid, maleic acid, acrylic acid, methacrylic acid, etc.

Examples of the material monomers for polyester resins include the above-mentioned polyhydric alcohol components and polyhydric carboxylic acid components.

Examples of the material monomers for vinyl resins include: styrene or styrene derivatives, such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins, such as ethylene, propylene, butylene and isobutylene; methacrylic acid alkyl esters, such as methylmethacrylate, n-propylmethacrylate, isopropylmethacrylate, n-butylmethacrylate, isobutylmethacrylate, t-butylmethacrylate, n-pentylmethacrylatet isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylic acid alkyl esters, such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate, and dodecylacrylate; unsaturated carboxylic acids, such as acrylic acid, methacrylic acid, itaconic acid and maleic acid; acrylonitrile, maleic acid ester, itaconic acid ester, vinyl chloride, vinylacetate, vinylbenzoate, vinylmethylethylketone, vinylhexylketone, vinylmethylether, vinylethylether, and vinylisobutylether. Examples of polymerization initiators used upon polymerizing the material monomers for vinyl resins include azo or diazo polymerization initiators such as 2,2'-azobis(2,4-dimethylvaleronitrile, 2,2'-azobisisobutyronitrile, 1,1'-azobis(cyclohexane-1-carbonitrile) and 2,2'-azobis-4-methoxy-2,4-dimethylvaleronitrile and peroxide polymerization initiators such as benzoyl peroxide, methylethylketone peroxide, isopropylperoxycarbonate and lauroyl peroxide.

For a binder resin component, vinyl resins formed of the above-mentioned material monomers may be used. Among vinyl resins, styrene-acrylic resins, which are obtained by copolymerizing styrene or styrene derivatives and methacrylic acid alkyl esters and/or acrylic acid alkyl esters, are preferably used.

Besides these, epoxy resins are preferably used particularly in full-color toners. Examples of epoxy 3resins preferably used in the present invention include polycondensated products between bisphenol A and epichlorohydrin. For example, Epomic R362, R364, R365, R367, R369 (made by Mitsui Sekiyukagaku K.K.), Epotot YD-011, YD-012, YD-014, YD-904, YD-017 (made by Touto Kasei K.K.) and Epi Coat 1002, 1004, 1007 (made by Shell Oil Co.) are commercially available.

In the present invention, from the viewpoint of heat resistant property, productivity and anti-offset property, in the case of color toners other than black toner, those polyester resins having a glass transition point of from 55 to 65° C. and a softening point of from 90 to 110° C. are preferably used as the binder resin, and in the case of black toner, those polyester resins having a glass transition point of from 55 to 65° C. and a softening point of 120 to 140° C. are preferably used as the binder resin.

In particular, from the viewpoint of fixing property and productivity, in the case of black toner, a first polyester resin having a softening point of from 95 to 120° C. and a second polyester resin having a softening point of from 130 to 160° C. are preferably used in combination. In this case, the glass transition point and the softening point of the mixed binder resin are preferably set in the above-mentioned ranges.

With respect to the colorant, conventionally known pigments and dyes may be used. A black colorant is used as black toner, and with respect to color toners other than black toner, other colorants are used. With respect to black colorants, for example, various carbon blacks, active carbon and titanium black, etc. are listed. With respect to other colorants, examples of them include aniline blue, Chalco Oil Blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Yellow 180, C.I. Pigment Yellow 185, C.I. Pigment Blue 15:1, C.I. Pigment Blue 15:3, etc. Moreover, in the case of black toner, in addition to various carbon black, active carbon and titanium black, one portion or all the portion of the colorant may be replaced by a magnetic material. With respect to such a magnetic material, known magnetic fine particles, such as ferrite, magnetite and iron, may be used. The average particle size of the magnetic particles is preferably set to not more than 1 $\mu$m, more preferably, not more than 0.5 $\mu$m.

The content of the colorant is preferably set in the range of from 1 to 10 parts by weight with respect to 100 parts by weight of the binder resin.

In order to improve the anti-offset property,. etc., the toner of the present invention may contain a wax as a releasing agent. Examples of such a wax include polyolefin wax, carnauba wax, rice wax, sazol wax, montan ester waxes, Fischer-Tropsch wax, etc. Among these, polyolefin was is preferably used. In the case of addition of a wax to the toner, although not particularly limited, the content is preferably set in the range of 0.5 to 5 parts by weight with respect to 100 parts by weight of the binder resin; thus, it becomes possible to obtain the effects of the addition without causing disadvantages, such as filming, etc. Two or more kinds of releasing agents may be used in combination, and in this case, the total amount of them is set in the above-mentioned range.

With respect to the polyolefin wax, examples thereof include oxidation-type polypropylene waxes, oxidation-type polyethylene waxes, polypropylene waxes, polyethylene waxes, etc., and among these, from the viewpoint of wax dispersing property, polyolefin waxes having an acid value of not more than 20 KOHmg/g are preferably used.

With respect to oxidation-type polypropylene waxes, Viscol 200TS (softening point 140° C., acid value 3.5), Viscol 100TS (softening point 140° C., acid value 3.5), Viscol 110TS (softening point 140° C., acid value 3.5) made by Sanyo Kasei Kogyo K.K., etc. are commercially available.

With respect to oxidation-type polyethylene, commercially available products are: San Wax E300 (softening point 103.5° C., acid value 22) and San Wax E250P (softening point 103.5° C., acid value 19.5) made by Sanyo Kasei Kogyo K.K., Hi Wax 4053E (softening point 145° C., acid value 25), 405MP (softening point 128° C., acid value 1.0), 310MP(softening point 122° C., acid value 1.0), 320MP (softening point 114° C., acid value 1.0), 210MP(softening point 118° C., acid value 1.0), 220MP(softening point 113° C., acid value 1.0), 220MP (softening point 113° C., acid value 1.0), 4051E(softening point 120° C., acid value 12), 4052E(softening point 115° C., acid value 20), 4202E (softening point 107° C., acid value 17) and 2203A (softening point 111° C., acid value 30) made by Mitsui Sekiyukagaku K.K., etc.

With respect to non-oxidation-type polyethylene waxes, for example, polyethylene wax 800P(softening point 140° C., acid value 0, made by Mitsui Sekiyukagaku K.K.) is commercially available.

In the present invention, from the viewpoint of anti-offset property (durability), in the case of color toners other than black toner, a polyolefin wax having a melting point in the range of from 140 to 150° C., in particular, an oxidation-type polypropylene wax, is preferably used. Moreover, from the viewpoint of anti-offset and smearing preventive properties, in the case of black toner, it is preferable to use a polyolefin wax having a melting point of from 110 to 130° C., in particular, an oxidation-type polyethylene wax, and a polyolefin wax having a melting point of from 140 to 150° C., in particular, an oxidation-type polypropylene wax, in a combined manner as a releasing agent.

In the application of carnauba wax, those having fine crystal are preferably used with their acid value preferably set in the range of from 0.5 to 10 KOHmg/g, and more preferably, from 1 to 6 KOHmg/g.

Montan waxes generally refer to montan ester waxes refined from minerals, and have fine crystal in the same fashion as carnauba wax; the acid value thereof is preferably set in the range of 1 to 20, and more preferably, 3 to 15.

Rice wax is obtained by air-oxidizing rice oil, and its acid value is preferably set in the range of 5 to 30 KOHmg/g.

Fisher-Tropsch wax is wax that is produced as a side product upon preparing synthetic oil from coal by using the hydrocarbon-synthesizing method; and for example, this is available as trade name "sazol wax" made by Sazol Co., Ltd. In addition to this, Fischer-Tropsch wax, made from natural gas as its initial material, may be preferably used since it has less low molecular ingredients and exhibits a superior heat resistance when used with toner.

With respect to the acid value of Fischer-Tropsch wax, those having an acid value of 0.5 to 30 KOHmg/g may-be used, and among sazol waxes, those of oxidation-type having an acid value of 3 to 30 KOHmg/g (trade name: sazol wax A1, A2, etc.) are, in particular, preferably used.

With respect to the charge-control agent, not particularly limited, for example, the following materials may be added: calix arene, boron compound, which are represented by the following general formula (A):

(A)

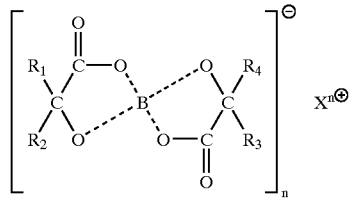

(In the formula, $R_1$ and $R_3$ respectively represent substituted or unsubstituted aryl groups independently, each of $R_2$ and $R_4$ independently represents a hydrogen atom, an alkyl group or a substituted or unsubstituted aryl group, and X represents a cation. n represents an integer of 1 or 2), a metal-containing dye such as a fluorine surface-active agent, a metal complex of salicylic acid and an azo metal compound, a high molecular acid such as a copolymer containing maleic acid as a monomer component, a quaternary ammonium salt, an azine dye such as nigrosine, carbon black, etc. Magnetic particles, etc., may be added to the toner of the present invention, if necessary. The content of the charge-control agent is preferably set in the range of 0.1 to 5 parts by weight with respect to 100 parts by weight of the binder resin.

The toner of the present invention, made from the above-mentioned materials, is effectively applicable to the formation of a color image as a toner set including a black toner and color toners other than the black toner, such as a yellow toner, a magenta toner and a cyan toner.

The toner of the present invention may be manufactured by any known method, such as a pulverizing method, an emulsion dispersing method, an emulsion polymerization method and a suspension polymerization method, as long as a toner having the above-mentioned weight-average particle size, compression rate, angle of repose, etc. is obtained; and, for example, it is effectively manufactured by the pulverizing method in accordance with the following sequence.

The above-mentioned binder resin, colorants and other desired additive agents are mixed in a conventional method, and after having been melted and kneaded, this is coarsely pulverized and finely pulverized, and then classified to give toner particles having a desired particle size. In the present invention, the toner particles thus obtained are subjected to an instantaneous heating treatment. Even after the instantaneous heating treatment, the particle-size distribution of the toner particles is hardly changed. The weight average particle size is controlled by properly adjusting the pulverizing conditions and/or the classifying conditions.

The classifying process may be carried out after the instantaneous heating treatment of the present invention. It is preferable to use a pulverizer which allows the pulverized particles to have a globular shape in the pulverizing process; thus, the instantaneous heating treatment, which is to be applied next, can be controlled more easily. Examples of such a device include Ionizer System (made by Hosokawa Micron K.K.), Criptron System (made by Kawasaki Jyukogyo K.K.), etc. As a classifier used in the classifying process, it is preferable to use such a classifier as to allow the processed particles to have a globular shape; this makes it easier to control the degree of roundness, etc. Examples of such a classifier include Teeplex Classifier (made by Hosokawa Micron K.K.).

In the present invention, the application of the instantaneous heating process makes it possible to reduce the compression rate, angle of repose and AD value of the toner particles obtained from the pulverizing method, and also to reduce thin pores located on the surface of the particles and consequently to improve the smoothness; thus, it becomes possible to provide a toner that is superior in the stress resistant property.

In the toner of the present invention, it is preferable to add various organic/inorganic fine particles as fluidizing-property adjusting agents (fluidizing agents) before the instantaneous heating treatment and/or after the toner preparation process. The application of such fluidizing-property adjusting agents makes it possible to further improve the fluidizing property of the toner of the present invention.

Examples of the inorganic fine particles include various carbides, such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam, various nitrides such as boron nitride, titanium nitride and zirconium nitride, bromide such as zirconium bromide, various oxides, such as titanium oxide, calcium oxide, magnesium oxide, zinc oxide, copper oxide, aluminum oxide, silica and colloidal silica, various titanic acid compounds, such as calcium titanate, magnesium titanate and strontium titanate, sulfide such as molybdenum disulfide, fluorides such as magnesium fluoride and carbon fluoride, various metal soaps, such as aluminum stearate, calcium stearate, zinc stearate and magnesium stearate, and various nonmagnetic inorganic fine particles such as talc and bentonite. These materials may be used alone or in combination. In particular, in the case of the application of inorganic fine particles such as silica, titanium oxide, alumina and zinc oxide, it is preferable to preliminarily carry out a surface treatment by a known method using a conventionally used hydrophobicizing agent, such as a silane coupling agent, a titanate coupling agent, silicone oil and silicone vanish, or using a treatment agent, such as a fluorine-based silane coupling agent or fluorine-based silicone oil, a coupling agent having an amino group and a quaternary aluminum salt group, and a modified silicone oil.

With respect to the organic fine particles, various organic fine particles, such as styrene particles, (metha)acrylic particles, benzoguanamine, melamine, Teflon, silicon, polyethylene and polypropylene, which are formed into particles by a wet polymerization method such as an emulsion polymerization method, a soap-free emulsion polymerization method and a non-aqueous dispersion polymerization method, and a vapor phase method, etc, may be used. These organic fine particles also serve as a cleaning-assist agent.

Inorganic fine particles, such as titanate metal salts, having a comparatively large particle size, and various organic fine particles may be, or may not be subjected to a hydrophobicizing treatment. The amount of addition of these fluidizing agents is preferably set from 0.1 to 6 parts by weight, and more preferably, from 0.5 to 3 parts by weight, with respect to 100 parts by weight of the toner particles. Moreover, the amount of addition in the externally adding process after the thermal treatment is preferably set from 0.1 to 5 parts by weight, and more preferably, from 0.5 to 3 parts by weight, with respect to 100 parts by weight of toner particles; however, it is preferable to properly adjust the amount of addition before and after the heat treatments In an instantaneous heating treatment which is used in the present invention, toner particles are dispersed and sprayed into a hot air by using compressed air so that the toner particles are surface-modified by heat.

Figure 3:
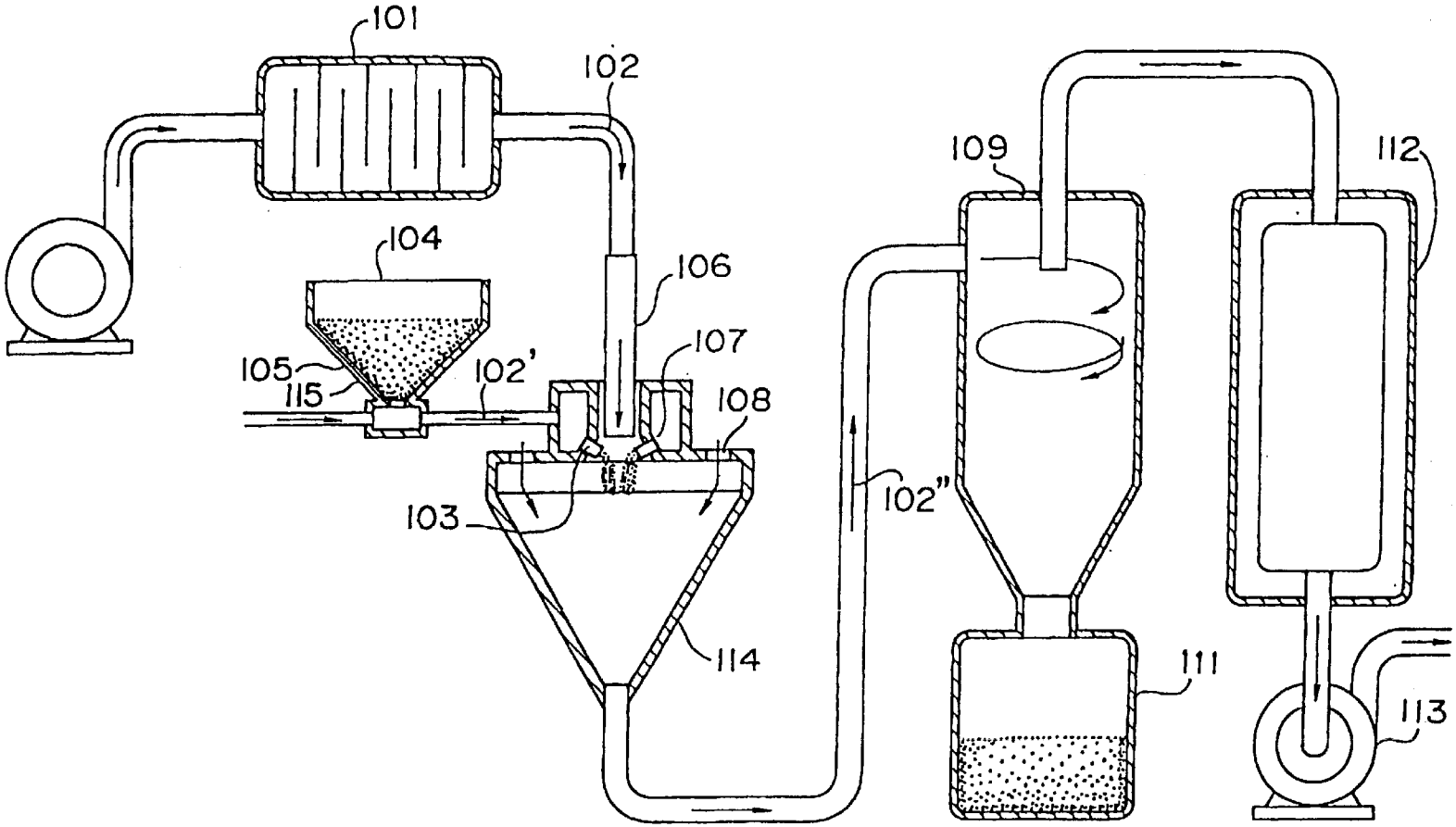
FIG. 3 is a schematic drawing that shows an instantaneous heating treatment device.
Figure 4:
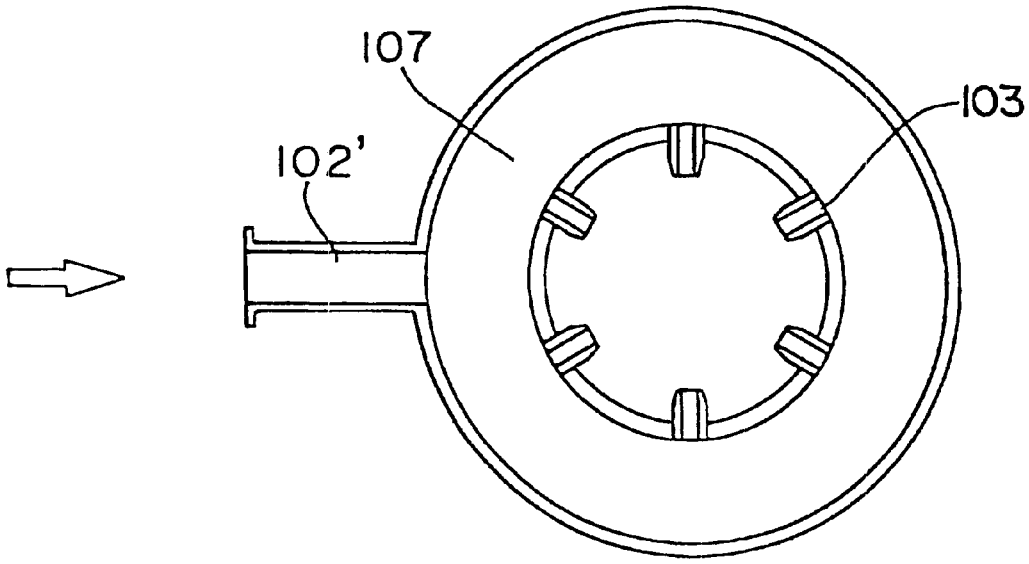
FIG. 4 is a schematic cross-sectional view of a sample-pulverizing chamber taken along a line in the horizontal direction in the device of FIG. 3.

Referring to schematic views of FIGS. 3 and 4, the following description will discuss the construction of a device that carries out the instantaneous heating treatment.

As illustrated in FIG. 3, high-temperature, high-pressure air (hot air), formed in a hot-air generating device 101, is discharged by a hot-air discharging nozzle 106 through a directing tube 102. Toner particles 105 are carried by a predetermined amount of pressurized air from a fixed amount supplying device 104 through a directing tube 102', and fed to a sample-discharging chamber 107 installed around the hot-air discharging nozzle 106.

As illustrated in FIG. 4, the sample-discharging chamber 107 has a hollow doughnut shape, and a plurality of sample-discharging nozzles 103 are placed on its inside wall with the same intervals. The toner particles, sent to the sample-discharging chamber 107, are allowed to spread inside the discharging chamber 107 in a dispersed state, and discharged through the sample-discharging nozzles 103 into the hot air flow by the pressure of air successively sent thereto.

It is preferable to provide a predetermined tilt to the sample-discharging nozzles 103 so as not-to allow the discharging flow from each sample-discharging nozzles 103 to cross the hot air flow. More specifically, the discharging is preferably made so that the toner discharging flow runs along the hot air flow to a certain extent; and the angle formed by the toner discharging flow and the direction of the central flow of the hot air flow is preferably set in the range of from 20 to 40, and preferably from 25 to 35. The angle wider than 40 causes the toner discharging flow to cross the hot air flow, resulting in collision with toner particles discharged from other nozzles and the subsequent aggregation of the toner particles. In contrast, the angle narrower than 20 left some toner particles not being taken in the hot air flow, resulting in irregularity in the toner particle shape.

A plurality of the sample-discharging nozzles 103 are required, and the number thereof is set to at least not less than 3, and preferably not less than 4. The application of a plurality of the sample-discharging nozzles makes it possible to uniformly disperse the toner particles into the hot air flow, and to ensure a heating treatment for each of the toner particles. With respect to the discharged state from the sample-discharging nozzle, it is preferably arranged so that the toner particles are widely scattered at the time of discharging and dispersed to the entire hot air flow without collision with other toner particles.

The toner particles, thus discharged are allowed to contact the high-temperature hot air instantaneously, and subjected to a heating treatment uniformly. Here, "instantaneously" refers to a time period during which a required toner-particle improvement (heating treatment) has been achieved without causing aggregation between the toner particles; and although it depends on the processing temperature and the density of toner particles in the hot air flow, this is normally set at not more than 2 seconds, and preferably not more than 1 second. This instantaneous time period is represented as a residence time of toner particles from the time when the toner particles are discharged from the sample-discharging nozzles to the time when they are guided into the directing tube 102". The residence time exceeding 2 seconds tends to cause joined particles. When the residence time is made as long as possible within the above-mentioned range, the toner compression rate and the angle of repose can be reduced, and the ratio D/d50 and AD value can be increased.

The toner particles, which have been instantaneously heated, are cooled off by a cold air flow directed from a cooling-air directing section 108, and collected into a cyclone 109 through the directing tube 102" without adhering to the device walls and causing aggregation between particles, and then stored in a production tank 111. The carrier air from which the toner particles have been removed is allowed to pass through a bug filter 112 by which file powder is removed therefrom, and released into the air through a blower 113. Here, the cyclone 109 is preferably provided with a cooling jacket through which cooling water runs, so as to prevent aggregation of toner particles.

In addition, important conditions for carrying out the instantaneous heating treatment include an amount of hot air, an amount of dispersing air, a dispersion density, a processing temperature, a cooling air temperature, an amount of suction air and a cooling water temperature. In particular, by controlling the processing temperature, it is possible to properly adjust the compression rate, angle of repose, AD value and D/d50 of the toner.

The processing temperature refers to a temperature within the heating treatment area. In the heating treatment area, a temperature gradient spreading outwards from the center actually exists, and it is preferable to reduce this temperature distribution at the time of the heating treatment. It is preferable to supply an air flow in a stable layer-flow state from the device face by using a stabilizer, etc. In the case of a non-magnetic toner using a binder resin having a sharp molecular-weight distribution, for example, a binder resin having a ratio of weight-average molecular weight/number-average molecular weight of from 2 to 20, it is preferable to carry out the heating treatment in a peak-temperature range of not less than the-glass transition point of the binder resin +100° C. to the glass transition point thereof +300° C. It is more preferable to carry it out in a peak-temperature range of not less than the glass transition point of the binder resin +110° C. to the glass transition point thereof +250° C. Here, the peak temperature range refers to a maximum temperature in the area in which the toner contact the hot air. In the case of a non-magnetic toner using a binder resin having a relatively wide molecular-weight distribution, for example, a binder resin having a ratio of weight-average molecular weight/number-average molecular weight of from 30 to 100, it is preferable to carry out the heating treatment in a peak-temperature range of not less than the glass transition point of the binder resin +100° C. to the glass transition point thereof +300° C. It is more preferable to carry it out in a peak-temperature range of not less than the glass transition point of the binder resin +150° C. to the glass transition point thereof +280° C. The reason for this is that, in order to improve the shape and surface homogeneity of the toner, it is necessary to apply a high level processing temperature so that even the high molecular region of the binder resin can be modified. However, the setting of the high level processing temperature, in contrast, tends to produce joined particles; therefore, tuning is required in which a fluidizing process prior to the heating treatment has to be set higher, or the dispersion density is set lower at the time of the treatment, etc. By raising the processing temperature as high as possible within the above-mentioned range, it becomes possible to reduce the toner compression rate and angle of repose most effectively, and also to increase the ratio D/d50 and AD value most effectively.

When wax is added to the toner particles, joined particles are more likely to occur. For this reason, tuning is required in which a fluidizing process (especially, fluidizing agents having a large particle size component) prior to the heating treatment is set higher, or the dispersion density is set lower at the time of the treatment, etc. This is essential to obtain toner particles of the present invention. These operations are particularly important when a binder resin having a relatively wide molecular weight distribution is used, or when the processing temperature is set to a higher level in an attempt to increase the compression rate and the angle of repose.

The amount of hot air refers to an amount of hot air supplied by the hot-air generating device 101. The greater the amount of hot air, the better in an attempt to improve the homogeneity of the heating treatment and the processing performance.

The amount of dispersing air refers to an amount of air that is to be sent to the directing tube 102' by the pressurized air. Although it also depends on other conditions, the amount of dispersing air is preferably suppressed during the heating treatment; this provides a better dispersed state of toner particles in a stable manner.

The dispersion density refers to a dispersion density of toner particles in a heating treatment area (more specifically, a nozzle discharging area). A preferable dispersion density varies depending on the specific gravity of toner particles; and the value obtained by dividing the classified density by the respective toner particles is preferably set in the range of from 50 to 300 g/m$^3$, preferably from 50 to 200 g/m$^3$.

The cooling air temperature refers to a temperature of cold air directed from the cooling-air directing section 108. The toner particles, after having been subjected to an instantaneous heating treatment, are preferably returned to an atmosphere under the glass transition point by using cold air so as to be cooled to a temperature range which causes no aggregation or joining of the toner particles. Therefore, the temperature of the cooling air is set at not more than 25° C., preferably not more than 15° C., and more preferably not more than 10° C. However, an excessive reduction in temperature might cause dew condensation in some conditions and adverse effects; this must be noted. In the instantaneous heating treatment as described above, together with a cooling effect by cooling water in the device as will be described next, since the time in which the binder resin is in a molten state is kept very short, it is possible to eliminate aggregation between the particles and adhesion of the particles to the device walls of the heat treatment device. Consequently, it becomes possible to provide superior stability even during continuous production, to greatly reduce the frequency of cleaning for the manufacturing devices, and to maintain the yield higher in a stable manner.

The amount of suction air refers to air used for carrying the processed toner particles to the cyclone by the blower 113. The greater the amount of suction air, the better in reducing the aggregation of the toner particles.

The temperature of cooling water refers to the temperature of cooling water inside the cooling jacket installed in the cyclones 109 and 114 and in the directing tube 102". The temperature of cooling water is set at not more than 25° C., preferably not more than 15° C., and more preferably not more than 10° C.

In order to obtain the toner of the present invention more effectively, it is preferable to further take the following measures.

(1) The amount of toner particles to be supplied to the hot air flow must be kept constant without generating pulsating movements, etc.

For this purpose; (i) a plurality of devices, such as a table feeder used at 115 shown in FIG. 1 and a vibration feeder, are used in combination so as to improve the fixed-amount supplying property. If a high-precision fixed-amount supply is achieved by using a table feeder and a vibration feeder, finely-pulverizing and classifying processes can be connected thereto so that toner particles can be supplied to the heating treatment process directly on an on-line basis.

(ii) After having been supplied by compressed air, prior to supplying toner particles into hot air, the toner particles are re-dispersed inside the sample-supplying chamber 107 so as to enhance the uniformity. For example, the following measures are adopted: the re-dispersion is carried out by using secondary air; the dispersed state of the toner particles is uniformed by installing a buffer section; and the re-dispersion is carried out by using a co-axial double tube nozzle, etc.

(2) When sprayed and supplied into a hot air flow, the dispersion density of the toner particles must be optimized and controlled uniformly.

For this purpose, (i) the supply into the hot air flow must be carried out uniformly, in a highly dispersed state, from all circumferential directions. More specifically, in the case of supply from dispersion nozzles, those nozzles having a stabilizer, etc. are adopted so as to improve the dispersion uniformity of the toner particles that are dispersed from each of the nozzles.

(ii) In order to uniform the dispersion density of the toner particles in the hot air flow, the number of nozzles is set to at least not less than three, and more preferably, not less than 4, as described earlier. The greater the number, the better, and these nozzles are placed symmetrically with respect to all the circumferential directions. Here, the toner particles may be supplied uniformly from slit sections installed all the 360-degree circumferential areas.

(3) Control must be properly made so that no temperature distribution of the hot air is formed in the processing area of toner particles so as to apply uniform thermal energy to each of the particles, and the hot air must be maintained in a layer-flow state.

For this purpose, (i) the temperature fluctuation of a heating source for supplying hot air must be reduced.

(ii) A straight tube section before the hot-air supplying section is made as long as possible. Alternatively, it is preferable to install a stabilizer in the vicinity of the hot-air supplying opening so as to stabilize the hot air. Moreover, the device construction, shown in FIG. 3 as an example, is an open system; therefore, since the hot air tends to be dispersed in a direction in which it contacts outer air, the supplying opening of the hot air may be narrowed on demands.

(4) The toner particles must be subjected to a sufficient fluidizing treatment so as to be maintained in a uniform dispersed-state during the heating treatment.

For this purpose, (i) in order to maintain sufficient dispersing and fluidizing properties of-the toner particles, inorganic fine particles (first inorganic fine particle) having a BET specific surface area of from 100 to 350 $m^2/g$, and more preferably, from 130 to 300 $m^2/g$, are preferably used. Here, it is preferable for these inorganic fine particles to be subjected to a hydrophobicizing treatment by a known hydrophobicizing agent. The amount of addition of the inorganic fine particles is set to 0.1 to 6 parts by weight, and more preferably, 0.3 to 3 parts by weight with respect to 100 parts by weight of toner particles.

(ii) In a mixing process for improving the dispersing and fluidizing properties, each of the fine particles is preferably located on the surface of the toner particle uniformly in an adhering state without being firmly fixed thereon.

(5) Even when the surface of the toner particle is subjected to heat, fine particles which have not been softened must be located on the surface of the toner particle so that a spacer effect is maintained between the toner particles with respect to their surface.

For this purpose, (i) it is preferable to add fine particles that have a particle size relatively larger than that of the inorganic fine particles shown in (4) and are not susceptible to softening at the treating temperature. The existence of the fine particles on the surface of the toner particle prevents the toner particle surface from forming a surface entirely made from the resin component, thereby providing the spacer effect between the toner particles and also preventing aggregation and joining between the toner particles.

(ii) In order to achieve such effects, inorganic fine particles (second inorganic fine particle) having a BET specific surface area of from 10 to 100 $m^2/g$, more preferably, from 20 to 90 $m^2/g$, and most preferably, from 20 to 80 $m^2/g$, are used. The amount of addition of the inorganic fine particles is set to from 0.05 to 5 parts by weight, and more preferably, from 0.3 to 3 parts by. weight with respect to 100 parts by weight of toner particles.

In the case when the first inorganic fine particles and the second inorganic fine particles are used in a combined manner, the difference between the BET specific surface areas of the two is set to not less than 30 $m^2/g$, and more preferably, 50 $m^2/g$.

(6) The collection of the heat-treated product must be controlled so as not to generate heat.

For this purpose, (i) the particles that are subjected to the heating treatment and cooling process are preferably cooled in a chiller in order to reduce heat generated in the piping system (especially, in R portions) and in the cyclone normally used in the collection of the toner particles.

(7) In the case of a process using magnetic toner having a relatively greater specific gravity with a small amount of resin component that contributes to the heating treatment, it is preferable to surround the heat-treating space in a cylinder shape so as to increase the time during which the treatment is virtually carried out, or to carry out the treatments several times.

The instantaneous heating treatment of the present invention may be carried out in combination with various processes for various developing agent in surface-modifying devices. Examples of these surface-modifying devices include surface-modifying devices using the high-speed gas-flow impact method, such as Hybridization System (made by Narakikai Seisakusho K.K.), Criptron Cosmos System (made by Kawasaki Jyukogyo K.K.) and Inomizer System (made by Hosokawa Micron K.K.), surface-modifying devices using the dry mechanochemical method, such as Mechanofusion System (made by Hosokawa Micron K.K.) and Mechanomill (made by Okadaseikou K.K.), and surface-modifying devices in which the wet coating method is applied, such as Disper Coat (made by Nisshin Engineering K.K.) and Coatmizer (made by Freund Sangyo K.K.). And these devices may be used appropriately in a combined manner.

The mono-component developing toner of the present invention, which is effectively manufactured by the above-mentioned method, is effectively applied to either of the color image-forming apparatus or the monochrome image-forming apparatus, as long as a developing device shown in FIG. 1 is installed therein.

Figure 2:
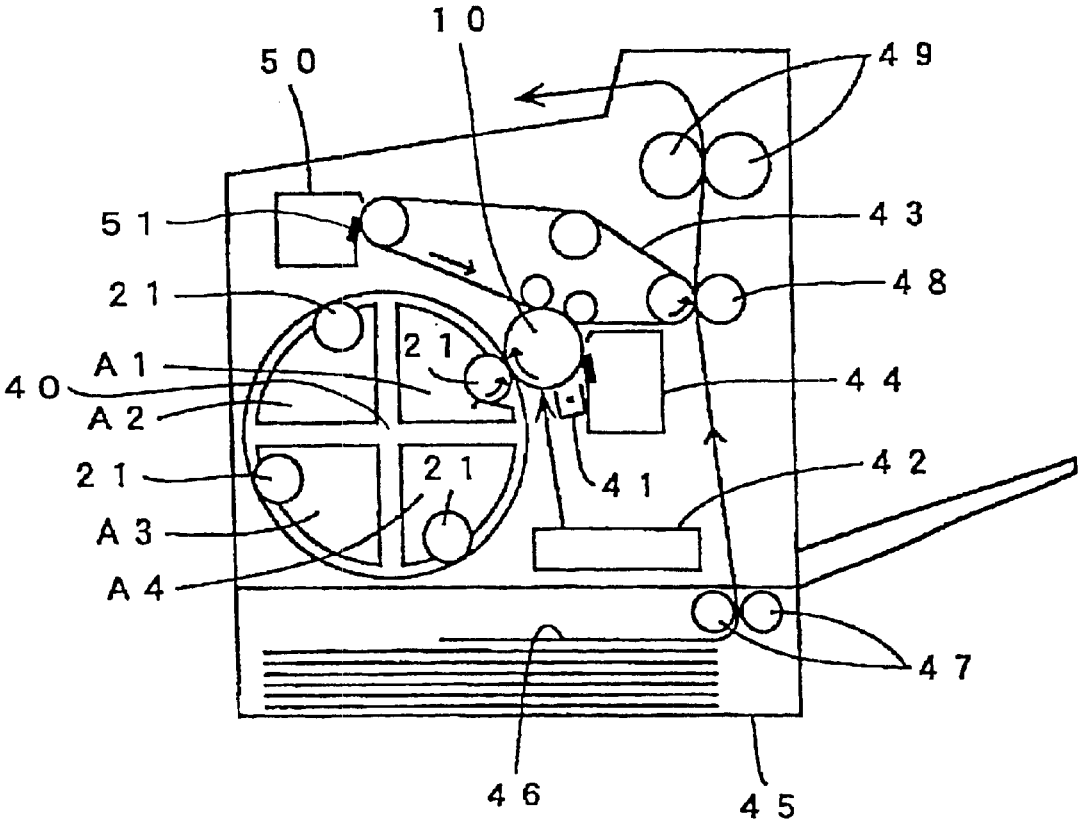
FIG. 2 is a schematic drawing that shows a structure of a color image-forming apparatus in which the developing device of FIG. 1 is installed.

FIG. 2 shows one example of a color image-forming apparatus to which the toner of the present invention is suitably applied. In the color image-forming apparatus schematically shown in FIG. 2, four of the above-mentioned developing devices A1 to A4 are used, and toners having respectively different colors of yellow, magenta, cyan and black are housed in these four developing devices A1 to A4. The four developing devices A1 to A4 are held on rotary holders 40, and the positions of the respective developing devices A1 to A4 are altered by the holders 40 so that each of the toner-supporting member 21 in the respective developing devices A1 to A4 is successively directed to the position facing an electrostatic latent image-supporting member 10, while at a developing area in which the toner supporting member 21 and the electrostatic latent image-supporting member 10 are aligned face to face with each other, the toner-supporting member 21 and the electrostatic latent image-supporting member 10 are respectively allowed to move upwards from below.

Upon forming a color image by using this color image-forming apparatus, for example, the toner-supporting member 21 in the first developing device A1 housing the yellow toner is first positioned so as to face the electrostatic latent image-supporting member 10, and the electrostatic latent image-supporting member 10 is rotated so that the surface of the electrostatic latent image-supporting member 10 is uniformly charged by a charging device 41. The electrostatic latent image-supporting member 10 thus charged is subjected to an exposing. process in accordance with an image signal by an exposing device 42 so that an electrostatic latent image is formed on the surface of the electrostatic latent image-supporting member 10.

At the developing area where the electrostatic latent image supporting member 10 having this electrostatic latent image formed thereon and the toner-supporting member 21 in the first developing device A1 are aligned face to face with each other, the toner-supporting member 21 and the electrostatic latent image-supporting member 10 are respectively allowed to shift upward from below, and the yellow toner is supplied from the toner-supporting member 21 to the electrostatic latent image portion formed on the electrostatic latent image supporting member 10; thus, a yellow toner image corresponding to the electrostatic latent image is formed on the electrostatic latent image-supporting member 10.

Then, the yellow toner image formed on the electrostatic latent image-supporting member 10 is transferred on an intermediate transfer member 43 provided as an endless belt passed over the electrostatic latent image supporting member 10. After the transferring process, residual yellow toner on the electrostatic latent image-supporting member 10 is removed from the electrostatic latent image-supporting member 10 by a cleaning device 44.

Thereafter, the holders 40 are rotated so that the toner-supporting member 21 in the second developing device A2 housing the magenta toner is next positioned so as to face the electrostatic latent image-supporting member 10. In the same manner as the first developing device A1, a toner image having the magenta color is formed on the surface of the electrostatic latent image-supporting member 10, and this toner image having the magenta color is transferred on the intermediate transfer member 43 bearing the yellow toner image that has been transferred thereon, and after the transferring process, residual magenta toner on the electrostatic latent image-supporting member 10 is removed from the electrostatic latent image-supporting member 10 by a cleaning device 44.

By carrying out the same processes, a toner image having the cyan color is formed on the surface of the electrostatic latent image-supporting member 10 by the third developing device A3 housing the cyan toner, and this toner image having the cyan color is transferred onto the intermediate transfer member 43, and a black toner image is formed on the surface of the electrostatic latent image supporting member 10 by the fourth developing device A4 housing black toner, and this black toner image is transferred onto the intermediate transfer member 43. In this manner, toner images having respective colors of yellow, magenta, cyan and black are transferred on the intermediate transfer member 43 so that a full-color toner image is formed.

A recording sheet 46 is directed by a transport roller 47 from a paper cassette 45 placed at a lower portion of the color image forming apparatus to a portion at which the intermediate transfer member 43 and a transferring roller 48 face each other so that the full-color toner image, formed on the intermediate transfer member 43, is transferred (secondary transferring process) on the recording sheet 46. Then, the full-color toner image, transferred on the recording sheet 46 in this manner, is fixed on the recording sheet 46 by a fixing device 49, and discharged, while toner left on the intermediate transfer member 43 without having been transferred is removed from the intermediate transfer member 43 by a cleaning device 50.

During the secondary transferring process, a secondary transferring voltage (not shown), applied to the transfer roller 48, is preferably set in the range of from 1000 to 3000V. Thus, it becomes possible to effectively prevent an insufficient transferring process.

With respect to a cleaning blade 51 in the cleaning device 50, those materials having an impact resilience of from 65 to 75% and a hardness of from 40 to 65 may be preferably used. The application of such a material makes it possible to prevent insufficient sweeping, separation of a blade and jitter.

Figure 7:
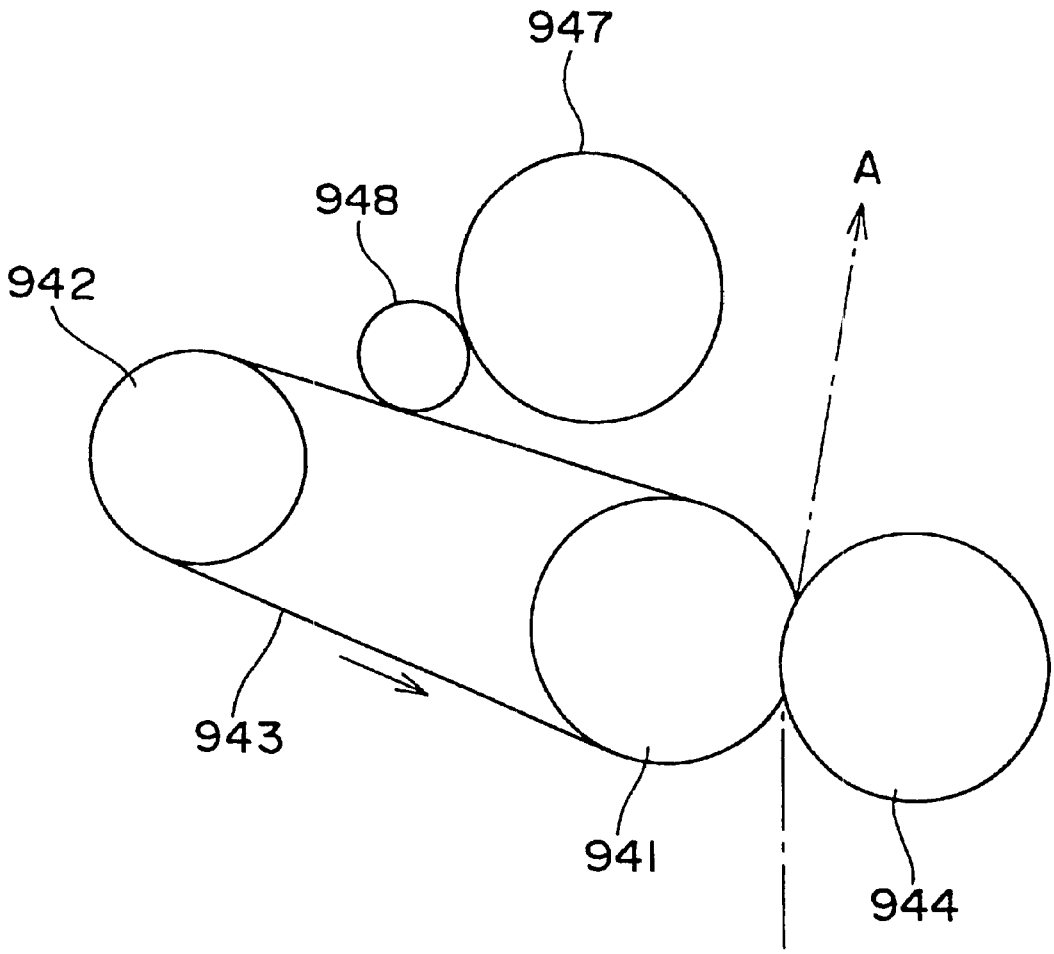
FIG. 7 is a schematic drawing that shows a fixing device.

More specifically, the fixing device 49 has a structure as shown in FIG. 7. The fixing device is provided with a fixing roller 941, a heating roller 942 placed apart from this, an elastic endless belt 943 used for heating that is passed over these, and a pressure roller 944 facing the driving roller 941 with the belt 943 located in between. The fixing roller 941 is supported by a fixing device housing, not shown, so as to rotate therein, and driven to rotate counterclockwise in the Figure by a motor, not shown. A roller 947, which applies silicon oil serving as a releasing agent to the belt 943 so as to prevent adhesion of molten toner, is made in contact with the belt 943 through a roller 948. In the Figure, arrow A indicates the shifting direction of recording sheet. The nip width at the contact portion between the fixing roller 941 and the pressure roller 944 is preferably set to from 7.0 to 9.0 mm and the fixing pressure thereof is preferably set to from 290 to 370N.

EXAMPLES

Production example of polyester resin A

To a four-necked flask provided with a thermometer, a stainless stirring stick, a dropping-type condenser and a nitrogen gas inlet tube were loaded polyoxypropylene(2,2)-2,2-bis(4-hydroxyphenyl)propane (PO), polyoxyethylene(2,0)-2,2-bis(4-hydroxyphenyl)propane (EO) and telephthalic acid (TPA), which were adjusted to a mole ratio of 4:6:9, together with a polymerization initiator (dibutyl tin oxide). This was allowed to react in a mantle heater by applying heat while being stirred under a nitrogen gas flow. The progress of the reaction was followed by measuring its acid value. At the time when a predetermined acid value had been reached, the reaction was completed, and this was cooled to room temperature to obtain a polyester resin. The polyester resin was coarsely pulverized into not more than 1 mm, and this was used in manufacturing toners which will be described later. Polyester resin A thus obtained has a softening point (Tm) of 110° C., a glass transition point (Tg) of 68° C., an acid value of 3.3 KOHmg/g, a hydroxide value of 28.1 KHOmg/g, a number-average molecular weight (Mn) of 3300, and a ratio of weight-average molecular weight (Mw)/number-average molecular weight (Mn) of 4.2.

Production example of polyester resin B

To a four-necked glass flask provided with a thermometer, a stirrer, a dropping-type condenser and a nitrogen gas inlet tube were loaded polyoxypropylene(2,2)-2,2-bis(4-hydroxyphenyl)propane, polyoxyethylene(2,2)-2,2-bis(4-hydroxyphenyl)propane, isododecenyl succinic anhydride, terephthalic acid and fumaric acid so as to be adjusted at a weight ratio of 82:77:16:32:30, together with dibutyl tin oxide as a polymerization initiator. This was allowed to react in a mantle heater while being stirred at 220° C. under a nitrogen gas atmosphere. A polyester resin B thus obtained had a softening point of 110° C., a glass transition point of 60° C., an acid value of 17.5 KOH mg/g, a hydroxide value of 35 KHOmg/g, a number-average molecular weight (Mn) of 2300, and a ratio of weight-average molecular weight (Mw)/number-average molecular weight (Mn) of 1.5.

Production example of polyester resin C

Styrene and 2-ethylhexylacrylate were adjusted to a X weight ratio of 17:3.2, and this was loaded into a dropping funnel together with dicumylperoxide as a polymerization initiator. To a four-necked glass flask provided with a thermometer, a stirrer, a dropping-type condenser and a nitrogen gas inlet tube were loaded polyoxypropylene(2,2)-2,2-bis(4-hydroxyphenyl)propane, polyoxyethylene(2,2)-2,2-bis(4-hydroxyphenyl)propane, isododecenyl succinic anhydride, terephthalic acid, 1,2,4-benzenetricarboxylic anhydride and acrylic acid so as to be adjusted at a weight ratio of 42:11:11:11:8:1, together with dibutyl tin oxide as a polymerization initiator. This was stirred at 135° C. in a mantle heater under a nitrogen gas atmosphere, with styrene, etc. being dropped therein from the dropping funnel, and then heated to 230° C. at which reaction was carried out. A polyester resin C thus obtained had a softening point of 150° C., a glass transition point of 62° C., an acid value of 24.5 KOH mg/g, a hydroxide value of 22.5 KHOmg/g, a number-average molecular weight (Mn) of 5000, and a ratio of weight-average molecular weight (Mw)/number-average molecular weight (Mn) of 15.

Example of preparation of pigment master batch

Polyester resin A (70 parts by weight) and magenta pigment (30 parts by weight)(C.I. Pigment Red 184) were loaded into a pressure kneader, and kneaded. After having. been cooled off, the resulting kneaded matter was coarsely pulverized by a feather mill, thereby obtaining a pigment master batch.

Experimental Example 1

Production example of toner

Example 1

| | |
|---|---|
| Polyester resin A | 93 parts by weight |
| Above-mentioned master batch | 10 parts by weight |
| Calix arene (E-89: Orient Chemical Co., Ltd.) | 2 parts by weight |
| Acid-type low molecular polypropylene (Viscol TS-200; Sanyo Kasei Kogyo K.K.) | 2 parts by weight |

The above-mentioned materials were sufficiently mixed by Henschel Mixer, and then melted and kneaded by using a twin screw extruder kneader (PCM-30; made by Ikegai Tekkou K.K.) whose discharging nozzle had been removed, and the resultant kneaded matter was quickly cooled, and coarsely pulverized by a feather mill. The pulverized matter was ground and coarsely classified by Jet mill (IDS: made by Nippon Pneumatic MFG), and then finely classified by DS classifier (made by Nippon Pneumatic MFG); thus, toner particles having a weight-average particle size of 7.0 $\mu$m was obtained. To 100 parts by weight of the toner particles were added 0.7 part by weight of hydrophobic silica (TS-500: made by Cabozyl Corp.) and 0.7 part by weight of hydrophobic silica (AEROSIL 90G: made by Nippon Aerosil K.K.) subjected to a modifying treatment by hexamethylenedisilazane; (BET specific surface area 70 $m^2$/g, pH 6.0, degree of hydrophobic property; not less than 65%), and this was mixed by Henschel Mixer (peripheral speed 30 m/sec, for 120 seconds), and then subjected to a surface-modifying treatment by heat under the following conditions by using an instantaneous heating device having a structure as shown in FIG. 3; thus, a toner was obtained.

Conditions of surface-modifying treatment

Developing agent supplying section; Table feeder+vibration feeder

Dispersing nozzle; Four (Symmetric layout with 90 degrees respectively to all circumference)

Discharging angle; 30 degrees

Amount of hot air; 800 L/min

Amount of dispersing air; 50 L/min

Amount of suction air; −1250 L/min

Dispersion density; 100 g/m$^3$
Processing temperature; 230° C.
Residence time; 0.5 second
Temperature of cooling air; 15° C.
Temperature of cooling water; 5° C.

Examples 2–5

The same manufacturing method and compositions as Example 1 were carried out except that fine particle classifying conditions were changed in the manufacturing method of Example 1 so as to change the weight-average particle size of the toner particle as described below, thereby obtaining toners (Examples 2 to 5).

| | | |
|---|---|---|
| Example 2: | weight-average particle size | 9.0 $\mu$m |
| Example 3: | weight-average particle size | 5.0 $\mu$m |
| Example 4: | weight-average particle size | 8.0 $\mu$m |
| Example 5: | weight-average particle size | 6.0 $\mu$m |

Examples 6 and 7

The same method and compositions as those of Example 1 were used except that the processing temperatures were changed to 190° C. and 300° C., respectively, thereby obtaining toners (Examples 6 and 7).

Example 8

To 100 parts by weight of the toner obtained in Example 4 were added 0.3 part of hydrophobic silica (R974: made by Nippon Aerosil K.K.) having a BET specific surface area of 140 m$^2$/g, 0.6 part of hydrophobic silica (NAX50: made by Nippon Aerosil K.K.) having a BET specific surface area of 140 m$^2$/g, and 1.0 part of strontium titanate particles having a BET specific surface area of 9 m$^2$/g, and this was mixed by Henschel Mixer (peripheral speed 40 m/sec, for 120 seconds). Thereafter, this was filtered through a circular vibration sieve (77 $\mu$m mesh).

Example 9

To 100 parts by weight of the toner obtained in Example 5 were added 0.5 part of hydrophobic silica (TS-500: made by Nippon Aerosil K.K.) having a BET specific surface area of 140 m$^2$/g and 1.0 part of strontium titanate particles having a BET specific surface area of 9 m$^2$/g, and this was mixed by Henschel Mixer (peripheral speed 40 m/sec, for 120 seconds). Thereafter, this was filtered through a circular vibration sieve (77 $\mu$m mesh).

Example 10

Polyester resin B(50 parts by weight), polyester resin C (50 parts by weight), 2 parts by weight of polyethylene wax (800P; made by Mitsui Sekiyu Kagaku K.K.), 2 parts by weight of polypropylene wax (TS-200; made by Sanyo Kasei Kogyo K.K.), 7 parts by weight of acid carbon black (MOGUL-L; made by Cabot Corporation; pH 2.5; average primary particle size 24 nm) and 2 parts by weight of a negative charge-control agent represented by the following Formula were sufficiently mixed by Henschel Mixer, and melt-kneaded by a twin screw extruder kneader. Then, this was cooled off, coarsely pulverized by a hammer mill, and finely pulverized by Jet mill, and then classified to obtain a toner having a weight-average particle size of 7.0 $\mu$m.

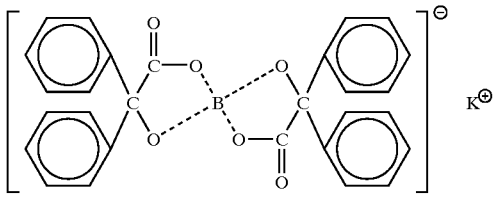

Comparative Example 1

The same materials as Example 1 were sufficiently. mixed by Henschel Mixer, and then melt-kneaded by using a twin screw extruder kneader (PCM-30; made by Ikegai Tekkou K.K.) whose discharging section had been removed, and the resultant kneaded matter was quickly cooled, and coarsely pulverized by a feather mill. The pulverized matter was allowed to pass through a Criptron (KTM III-type made by Kawasaki Jyukogyo K.K.) two times, and coarsely classified by a pulverizer (IDS: made by Nippon Pneumatic MFG), and then finely classified by a 100ATP classifier (made by Nippon Pneumatic MFG); thus, a toner having a weight-average particle size of 7.0 $\mu$m was obtained.

Comparative Example 2

Toner particles obtained prior to the heat treatment in Example 1 was used as a toner.

Comparative Example 3

The same method and compositions as those of Example 1 were used except that the processing temperature was changed to 150° C., thereby obtaining a toner.

To 100 parts by weight of the toner obtained in the respective Examples and Comparative Examples (except for toners obtained in Examples 8 and 9) were added 0.5 part of hydrophobic silica (R974; made by Nippon Aerosil K.K.) having a BET specific surface area of 140 m$^2$/g and 1.0 part of strontium titanate particles having a BET specific surface area of 9 m$^2$/g, and this was mixed by Henschel Mixer (peripheral speed 40 m/sec, for 120 seconds). Thereafter, this was filtered through a circular vibration sieve (77 $\mu$m mesh).

With respect to the respective toners, d50, D/d50, the angle of repose, compression rate and the AD value were measured.

Each of the toners was loaded into the color image-forming apparatus shown in FIG. 2 in which the developing devices of FIG. 1 had been installed, and evaluated under N/N environment conditions (23±3° C., 45±10%) in the following manner. The process conditions in the developing device of FIG. 1 are explained as follows: Here, the evaluation was made on the third image that had been produced.

Peripheral speed of toner-supplying member/Peripheral speed of toner-supporting member (S2/S1); 1.2

Toner-supporting member
DC resistivity; $1\times10^6\Omega$
AC resistivity; $1\times10^5\Omega$
DS; 0.18 mm Developing conditions
f; 2000 Hz Secondary transferring voltage
Voltage; 1200 v Photosensitive member cleaning Impact resilience; 68%
Hardness; 50

Fixing
Nip width; 7.9 mm
Pressure; 310 N

Density unevenness

A half-tone image was duplicated, and the entire surface was observed for unevenness in density.

○: A half-tone image with uniform image density was obtained;

Δ: Although unevenness was slightly found, it was within a permissible range; and X: Unevenness was observed in the half-tone image.

Follow-up properties of solid image

A solid image was duplicated.

○: A solid image with uniform image density was obtained. There was no difference in image density between the leading edge and rear edge of the solid image;

Δ: Although there was a difference in image density between the leading edge and rear edge of the solid image, it was within a permissible range; and X: There was a great difference in image density between the leading edge and rear edge of the solid image.

Leak

A white image was duplicated.

○: No leak (black spots) occurred in the white image;

Δ: Although slight leaks (black spots) occurred in the white image, no problem arose in the practical use; and X: Many leaks (black spots) occurred in the white image.

Gradation

Images having dot area rates of 100%, 50% and 20% were duplicated by using a screen with 150 lines, and the respective densities were measured using a transmission densitometer.

○: With respect to the dot area rates of 100%, 50% and 20%, the transmission densities changed linearly;

Δ: With respect to the dot area rates of 100%, 50% and 20%, the transmission densities did not change linearly; however, no problem arose in the practical use; and X: With respect to the dot area rates of 100%, 50% and 20%, no dependence was found in the transmission densities.

Experimental Example 2

Example 11

The toner of Example 3 was used, and evaluation was made thereon under the same conditions as Experimental Example 1 except that the peripheral speed of the toner-supplying member to the peripheral speed of the toner-supporting member was set to 0.8 in the developing device.

Example 12

The toner of Example 2 was used, and evaluation was made thereon under the same conditions as Experimental Example 1 except that the peripheral speed of the toner-supplying member to the peripheral speed of the toner-supporting member was set to 2.0 in the developing device.

Example 13

The toner of Example 1 was used, and evaluation was made thereon under the same conditions as Experimental Example 1 except that the DC resistivity of the toner-supporting member was set to $7\times10^4\Omega$.

Example 14

The toner of Example 1 was used, and evaluation was made thereon under the same conditions as Experimental Example 1 except that the DC resistivity of the toner-supporting member was set to $3.1\times10^7\Omega$.

Example 15

The toner of Example 1 was used, and evaluation was made thereon under the same conditions as Experimental Example 1 except that the AC resistivity of the toner-supporting member was set to $1.9\times10^2\Omega$.

Example 16

The toner of Example 1 was used, and evaluation was made thereon under the same conditions as Experimental Example 1 except that the AC resistivity of the toner-supporting member was set to $5.1\times10^5\Omega$.

Example 17

The toner of Example 1 was used, and evaluation was made thereon under the same conditions as Experimental Example 1 except that the DS was set to 0.04 mm.

Example 18

The toner of Example 1 was used, and evaluation was made thereon under the same conditions as Experimental Example 1 except that the DS was set to 0.25 mm.

Example 19

The toner of Example 1 was used, and evaluation was made thereon under the same conditions as Experimental Example 1 except that the frequency in the developing conditions was set to 900 Hz.

Example 20

The toner of Example 1 was used, and evaluation was made thereon under the same conditions as Experimental Example 1 except that the frequency in the developing conditions was set to 3100 Hz.

Example 21

The toner of Example 1 was used, and evaluation was made thereon under the same conditions as Experimental Example 1 except that the peripheral speed of the toner-supporting member and the peripheral speed of the toner-supplying member were changed so as to set K-value to 0.238. Here, K-value represents $S2/S1\times T$ (hereinafter, the same is true).

Example 22

The toner of Example 1 was used, and evaluation was made thereon under the same conditions as Experimental Example 1 except that the peripheral speed of the toner-supporting member and the peripheral speed of the toner-supplying member were changed so as to set K-value to 1.283.

TABLE 1

| | Toner | | | | | | | | | | Toner-supporting member | | | Developing |
|---|---|---|---|---|---|---|---|---|---|---|---|---|---|---|
| | Resin | | Wax | | | Com- | Angle | | | K- | DC | AC | | condition |
| | Tg | Tm | Melting point | d50 | D/d50 | pression rate | of repose | AD value | S2/S1 | value | resistivity | resistivity | DS | f |
| Ex. 1 | 68° C. | 110° C. | 140° C. | 7.0 μm | 0.54 | 28.3 | 33 | 0.475 | 1.2 | 0.57 | $1 \times 10^6$ | $1 \times 10^5$ | 0.18 mm | 2000 Hz |
| Ex. 2 | 68° C. | 110° C. | 140° C. | 9.0 μm | 0.54 | 26.8 | 30 | 0.523 | 1.2 | 0.628 | $1 \times 10^6$ | $1 \times 10^5$ | 0.18 mm | 2000 Hz |
| Ex. 3 | 68° C. | 110° C. | 140° C. | 5.0 μm | 0.54 | 31.1 | 37 | 0.425 | 1.2 | 0.51 | $1 \times 10^6$ | $1 \times 10^5$ | 0.18 mm | 2000 Hz |
| Ex. 4 | 68° C. | 110° C. | 140° C. | 8.0 μm | 0.52 | 27.5 | 32 | 0.501 | 1.2 | 0.601 | $1 \times 10^6$ | $1 \times 10^5$ | 0.18 mm | 2000 Hz |
| Ex. 5 | 68° C. | 110° C. | 140° C. | 6.0 μm | 0.55 | 29.5 | 35 | 0.453 | 1.2 | 0.544 | $1 \times 10^6$ | $1 \times 10^5$ | 0.18 mm | 2000 Hz |
| Ex. 6 | 68° C. | 110° C. | 140° C. | 7.0 μm | 0.52 | 29.3 | 35 | 0.459 | 1.2 | 0.551 | $1 \times 10^6$ | $1 \times 10^5$ | 0.18 mm | 2000 Hz |
| Ex. 7 | 68° C. | 110° C. | 140° C. | 7.0 μm | 0.57 | 27.7 | 31 | 0.492 | 1.2 | 0.59 | $1 \times 10^6$ | $1 \times 10^5$ | 0.18 mm | 2000 Hz |
| Ex. 8 | 68° C. | 110° C. | 140° C. | 8.0 μm | 0.52 | 27.9 | 34 | 0.489 | 1.2 | 0.587 | $1 \times 10^6$ | $1 \times 10^5$ | 0.18 mm | 2000 Hz |
| Ex. 9 | 68° C. | 110° C. | 140° C. | 6.0 μm | 0.55 | 28.9 | 32 | 0.466 | 1.2 | 0.559 | $1 \times 10^6$ | $1 \times 10^5$ | 0.18 mm | 2000 Hz |
| Ex. 10 | 60° C. | 130° C.* | 120° C. 140° C. | 7.0 μm | 0.54 | 28 | 32 | 0.48 | 1.2 | 0.576 | $1 \times 10^6$ | $1 \times 10^5$ | 0.18 mm | 2000 Hz |

*In Example 10, Tg and Tm in the resin represent Tg and Tm in a mixed resin.

TABLE 2

| | Toner | | | | | | | | | | Toner-supporting member | | | Developing |
|---|---|---|---|---|---|---|---|---|---|---|---|---|---|---|
| | Resin | | Wax | | | Com- | Angle | | | K- | DC | AC | | condition |
| | Tg | Tm | Melting point | d50 | D/d50 | pression rate | of repose | AD value | S2/S1 | value | resistivity | resistivity | DS | f |
| Ex. 11 | 68° C. | 110° C. | 140° C. | 5.0 μm | 0.54 | 31.1 | 37 | 0.425 | 0.8 | 0.34 | $1 \times 10^6$ | $1 \times 10^5$ | 0.18 mm | 2000 Hz |
| Ex. 12 | 68° C. | 110° C. | 140° C. | 9.0 μm | 0.54 | 26.8 | 30 | 0.523 | 2.0 | 1.046 | $1 \times 10^6$ | $1 \times 10^5$ | 0.18 mm | 2000 Hz |
| Ex. 13 | 68° C. | 110° C. | 140° C. | 7.0 μm | 0.54 | 28.3 | 33 | 0.475 | 1.2 | 0.57 | $7 \times 10^4$ | $1 \times 10^5$ | 0.18 mm | 2000 Hz |
| Ex. 14 | 68° C. | 110° C. | 140° C. | 7.0 μm | 0.54 | 28.3 | 33 | 0.475 | 1.2 | 0.57 | $3.1 \times 10^7$ | $1 \times 10^5$ | 0.18 mm | 2000 Hz |
| Ex. 15 | 68° C. | 110° C. | 140° C. | 7.0 μm | 0.54 | 28.3 | 33 | 0.475 | 1.2 | 0.57 | $1 \times 10^6$ | $1.9 \times 10^2$ | 0.18 mm | 2000 Hz |
| Ex. 16 | 68° C. | 110° C. | 140° C. | 7.0 μm | 0.54 | 28.3 | 33 | 0.475 | 1.2 | 0.57 | $1 \times 10^6$ | $5.1 \times 10^5$ | 0.18 mm | 2000 Hz |
| Ex. 17 | 68° C. | 110° C. | 140° C. | 7.0 μm | 0.54 | 28.3 | 33 | 0.475 | 1.2 | 0.57 | $1 \times 10^6$ | $1 \times 10^5$ | 0.04 mm | 2000 Hz |
| Ex. 18 | 68° C. | 110° C. | 140° C. | 7.0 μm | 0.54 | 28.3 | 33 | 0.475 | 1.2 | 0.57 | $1 \times 10^6$ | $1 \times 10^5$ | 0.25 mm | 2000 Hz |
| Ex. 19 | 68° C. | 110° C. | 140° C. | 7.0 μm | 0.54 | 28.3 | 33 | 0.475 | 1.2 | 0.57 | $1 \times 10^6$ | $1 \times 10^5$ | 0.18 mm | 900 Hz |
| Ex. 20 | 60° C. | 110° C. | 120° C. | 7.0 μm | 0.54 | 28.3 | 33 | 0.475 | 1.2 | 0.57 | $1 \times 10^6$ | $1 \times 10^5$ | 0.18 mm | 31000 Hz |
| Ex. 21 | 68° C. | 110° C. | 140° C. | 7.0 μm | 0.54 | 28.3 | 33 | 0.475 | 0.5 | 0.238 | $1 \times 10^6$ | $1 \times 10^5$ | 0.18 mm | 2000 Hz |
| Ex. 22 | 68° C. | 110° C. | 140° C. | 7.0 μm | 0.54 | 28.3 | 33 | 0.475 | 2.7 | 1.283 | $1 \times 10^6$ | $1 \times 10^5$ | 0.18 mm | 2000 Hz |
| Com. Ex. 1 | 68° C. | 110° C. | 140° C. | 7.0 μm | 0.52 | 29.5 | 41 | 0.485 | 1.4 | 0.679 | $1 \times 10^6$ | $1 \times 10^5$ | 0.18 mm | 2000 Hz |
| Com. Ex. 2 | 68° C. | 110° C. | 140° C. | 7.0 μm | 0.36 | 33.5 | 38 | 0.39 | 1.4 | 0.546 | $1 \times 10^6$ | $1 \times 10^5$ | 0.18 mm | 2000 Hz |
| Com. Ex. 3 | 68° C. | 130° C. | 140° C. | 7.0 μm | 0.53 | 34 | 35 | 0.425 | 1.4 | 0.595 | $1 \times 10^6$ | $1 \times 10^5$ | 0.18 mm | 2000 Hz |

TABLE 3

| | Density unevenness | Follow-up properties of solid image | Leak | Gradation |
|---|---|---|---|---|
| Example 1 | ○ | ○ | ○ | ○ |
| Example 2 | ○ | ○ | ○ | ○ |
| Example 3 | ○ | ○ | ○ | ○ |
| Example 4 | ○ | ○ | ○ | ○ |
| Example 5 | ○ | ○ | ○ | ○ |
| Example 6 | ○ | ○ | ○ | ○ |
| Example 7 | ○ | ○ | ○ | ○ |
| Example 8 | ○ | ○ | ○ | ○ |
| Example 9 | ○ | ○ | ○ | ○ |
| Example 10 | ○ | ○ | ○ | ○ |
| Example 11 | Δ | Δ | ○ | ○ |
| Example 12 | Δ | Δ | ○ | ○ |
| Example 13 | ○ | ○ | Δ | ○ |
| Example 14 | Δ | ○ | ○ | ○ |
| Example 15 | ○ | ○ | Δ | ○ |
| Example 16 | Δ | ○ | ○ | ○ |
| Example 17 | ○ | ○ | Δ | ○ |

TABLE 3-continued

| | Density unevenness | Follow-up properties of solid image | Leak | Gradation |
|---|---|---|---|---|
| Example 18 | Δ | ○ | ○ | ○ |
| Example 19 | ○ | ○ | ○ | Δ |
| Example 20 | Δ | ○ | ○ | ○ |
| Example 21 | Δ | Δ | ○ | ○ |
| Example 22 | Δ | Δ | ○ | ○ |
| Comparative Example 1 | X | X | ○ | ○ |
| Comparative Example 2 | X | X | ○ | ○ |
| Comparative Example 3 | X | X | ○ | ○ |

In the present specification, the following measured values were obtained by the following methods.

Weight-average particle size

The weight-average particle size (d50) was measured by using Coulter Multisizer (made by Coulter Counter Co., Ltd.). The weight-average particle size (d50) is a particle size corresponding to 50% of the relative weight distribution classified by particle sizes.

DC resistivity

Figure 5:
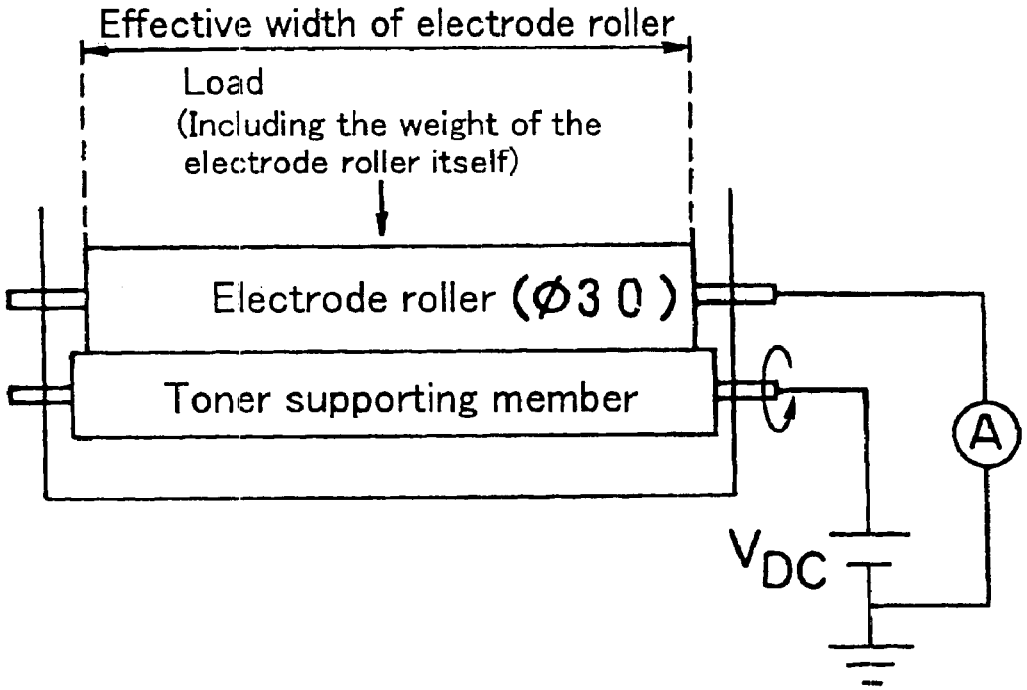
FIG. 5 is a schematic drawing that shows a method for measuring the DC resistivity.

As illustrated in FIG. 5, the toner-supporting member was pressed by an electrode roller (resistivity; 0Ω), and a DC voltage was applied to the contact portion while both of the members were rotated in the same direction; thus, the flowing current value was measured so that the DC resistivity of the toner-supporting member was found based upon R=V/I. Detailed measuring conditions are described as follows:

Measuring environments; 23±5° C., 57±10%

Applied voltage; +100 V

Number of revolutions of roller; 27 rpm

Electrode roller load; 1 kg (including the weight of the electrode roller itself)

Effective width of electrode roller; 230 mm

Measurements; current value (average value 5 seconds after voltage application)

AC resistivity

Figure 6:
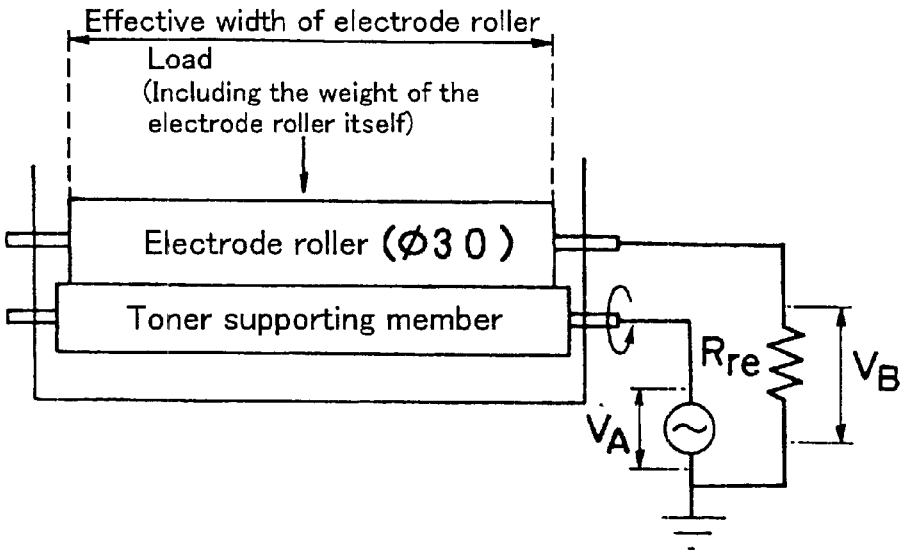
FIG. 6 is a schematic drawing that shows a method for measuring the AC resistivity.
Figure 6:
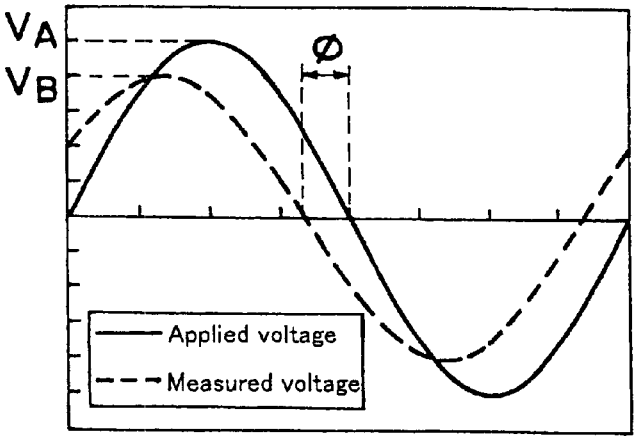

As illustrated in FIG. 6(*a*), the toner-supporting member was pressed by the electrode roller, and an AC voltage was applied to the contact portion while both of the members were rotated in the same direction; thus, the voltage waveform between fixed resistor terminals, for example, as shown in FIG. 6(*b*), was measured so that the AC resistivity ($Z_R$) of the toner-supporting member was found based upon the following equation. Detailed measuring conditions are described as follows:

$$Z_R=a+b\cdot i$$

$$a=(V_A/V_B\cdot\cos-1)\cdot R_{ref}$$

$$b=V_A/V_B\cdot R_{ref}\cdot\sin\phi$$

Measuring environments; 23±5° C., 57±10%

Applied voltage ($V_A$); AC, sine waveform, 2 kHz, 2 $kv_{pp}$

Number of revolutions of roller; 27 rpm

Electrode roller load; 1 kg (including the weight of the electrode roller)

Effective width of electrode roller; 230 mm

Fixed resistivity ($R_{ref}$); 500 kΩ

Measurements ($V_B$); voltage waveform between fixed resistor terminals (average value 5 seconds after voltage application)

Glass transition point

The glass transition point (Tg) of resins was measured by the following method. A differential scanning calorimeter (DSC-200: made by Seiko Instrument K.K.) was used in which: 10 mg of a sample to be measured was precisely weighed, and this was put into an aluminum pan, while α-alumina was put into an aluminum pan so as to be used as reference, and was heated to 200° C. from normal temperature at a temperature-rise rate of 30° C./min, and this was then cooled, and subjected to measurements in the range of from 20° C. to 160° C. at a temperature-rise rate of 10° C./min; thus, during this temperature-rise process, the shoulder value of the main heat-absorption peak in the range of from 30° C. to 90° C. was defined as the glass transition point Tg.

Softening point

The softening point of resins was measured by the following method. A flow tester (CFT-500: made by Shimadzu Seisakusho K.K.) was used, and 1 $cm^2$ of sample was melted and allowed to flow under conditions of a thin pore of a die (diameter 1 mm, length 1 mm), an applied pressure of 20 $kg/cm^3$ and a temperature rise rate of 6.0° C./min; thus, the temperature corresponding to ½ of the height from the flow-starting point to the flow-end point was defined as the softening point.

Number-average molecular weights weight-average molecular weight

Measurements were made by using a gel permeation chromatography (807-IT Type: Nippon Bunko Kogyo K.K.) in which: 1 $kg/cm^2$ of tetrahydrofuran was allowed to flow at 1 kg/cm as a carrier solvent while the column was maintained at 40° C., and 30 mg of a sample to be measured was dissolved in 20 ml of tetrahydrofuran, and then, 0.5 mg of this solution was introduced together with the carrier solvent; thus these molecular weights were measured based upon polystyrene conversion.

With respect to the acid value, 10 mg of a sample was dissolved in 50 ml of toluene, and this was titrated by a solution of N/10 potassium hydride/alcohol that had been preliminarily set, using an mixed indicator of 0.1% of bromo-thymol blue and phenol red; thus, the value was calculated from the amount of consumption of the solution of N/10 potassium,hydride/alcohol.

The toner of the present invention maintains superior fluidity and makes it possible to provide a high-quality image even when it is applied to a developing device in which a comparatively great stress is imposed on the toner particles. In other words, the resulting image is free from unevenness in density and leak, and superior in the follow-up properties of solid image and gradation.

What is claimed is:

1. A non-magnetic mono-component developing device, which develops an electrostatic latent image formed on an image-supporting member with a toner, comprising:

a toner-supporting member that is placed face to face with the image-supporting member, the surface of said toner-supporting member moving upwards from below at a developing area in which said toner-supporting member and said image-supporting member are placed face to face with each other;

a toner housing chamber for housing a toner having a weight-average particle size of from 4 to 10 μm, a compression rate of not more than 32% and an angle of repose of not more than 38°; and a toner-supplying member for supplying the toner housed in the toner housing chamber to said toner-supporting member, said toner-supplying member being placed face to face with said toner-supporting member, the surface of said toner-supplying member and the surface of said toner-supporting member being allowed to move in opposite directions from each other at the face to face area.

2. The developing device of claim 1, wherein: a gap between said toner-supporting member and said electrostatic latent image-supporting member is in a range of from 0.05 to 0.2 mm, and a developing bias voltage formed by multiplexing an AC voltage having a frequency of from 1000 to 3000 Hz on a DC voltage is applied to said toner-supporting member.

3. The developing device of claim 1, wherein said toner-supporting member has an AC resistivity in a range of from $2\times10^2$ to $5\times10^5$Ω, and a DC resistivity in the range of from $7.5\times10^4$ to $3\times10^7$Ω.

4. The developing device of claim 1, wherein a ratio $S_2/S_1$ between a peripheral speed $S_1$ of said toner-supporting member and a peripheral speed $S_2$ of said toner-supplying member is set in a range of from 0.4 to 2.8.

5. The developing device of claim 4, wherein said $S_2/S_1$ and an aerated bulk density T of the toner satisfy the following relationship: $0.25 \leqq S_2/S_1 \times T \leqq 1.26$.

6. The developing device of claim 1, wherein the toner-supplying member is placed in contact with the toner-supporting member.

7. The developing device of claim 1, further comprising a charging blade and a regulating blade, the charging blade being placed in contact with the toner-supporting member and being positioned on a downstream side of the toner-supplying member with respect to the surface-moving direction of the toner-supporting member, the regulating blade being placed in contact with the toner-supporting member and being positioned on a downstream side of the charging blade with respect to the surface-moving direction of the toner-supporting member.

8. The developing device of claim 1, wherein said toner has a degree of surface smoothness of not less than 0.4.

9. The developing device of claim 1, wherein said toner has an aerated bulk density in a range of 0.4 to 0.6 g/cm$^3$.

10. The developing device of claim 1, wherein the toner contains a polyester resin having a glass transition point of from 55 to 65° C. and a softening point of from 90 to 110° C., a colorant having a color other than black and a polyolefin wax having a melting point of from 140 to 150° C.

11. The developing device of claim 1, wherein the toner contains a polyester resin having a glass transition point of from 55 to 65° C. and a softening point of from 120 to 140° C., a black colorant, a polyolefin wax having a melting point of from 110 to 130° C. and a polyolefin wax having a melting point of from 140 to 150° C.

12. A toner for being used in a non-magnetic mono-component developing device, the mono-component developing device comprising: a toner-supporting member that is placed face to face with an image-supporting member, the surface of toner-supporting member and the surface of the image-supporting member moving upwards from below at a developing area in which said toner-supporting member and said image-supporting member are placed face to face with each other, a toner-supplying member being placed face to face with said toner-supporting member, with the surface of said toner-supplying member and the surface of said toner-supporting member being allowed to move in opposite directions from each other at the face to face area, in which the toner comprises:

a weight-average particle size of from 4 to 10 μm;

a compression rate of not more than 32%, and an angle of repose of not more than 38°.

13. The toner of claim 12, wherein the weight-average particle size is set in a range of from 5 to 9 μm, the compression rate is set to not more than 31%, and the angle of repose is set in a range of from 29 to 37°.

14. The toner of claim 12, wherein the developing device comprises a charging blade and a regulating blade, the charging blade being placed in contact with the toner-supporting member and being positioned on a downstream side of the toner-supplying member with respect to the surface-moving direction of the toner-supporting member, the regulating blade being placed in contact with the toner-supporting member and being positioned on a downstream side of the charging blade with respect to the surface-moving direction of the toner-supporting member.

15. The toner of claim 12, having a degree of surface smoothness in a range of from 0.4 to 0.8.

16. The toner of claim 15, having a degree of surface smoothness in a range of from 0.45 to 0.7.

17. The toner of claim 12, having an aerated bulk density in a range of from 0.4 to 0.6 g/cm$^3$.

18. The toner of claim 17, having an aerated bulk density in a range of from 0.4 to 0.55 g/cm$^3$.

19. The toner of claim 12, containing a polyester resin having a glass transition point of from 55 to 65° C. and a softening point of from 90 to 110° C., a colorant having a color other than black and a polyolefin wax having a melting point of from 140 to 150° C.

20. The toner of claim 12, containing a polyester resin having a glass transition point of from 55 to 65° C. and a softening point of from 120 to 140° C., a black colorants a polyolefin wax having a melting point of from 110 to 130° C. and a polyolefin wax having a melting point of from 140 to 150° C.

21. An image forming apparatus comprising:

an image-supporting member, a non-magnetic mono-component developing device for forming a toner image on the image-supporting member and an intermediate transfer member to which the toner image formed on the image-supporting member is transferred;

the developing device comprising:

a toner-supporting member that is placed face to face with the image-supporting member, the surface of said toner-supporting member moving upwards from below at a developing area in which said toner-supporting member and said image-supporting member are placed face to face with each other;

a toner housing chamber for housing a toner having a weight-average particle size of from 4 to 10 μm, a compression rate of not more than 32% and an angle of repose of not more than 38°; and a toner-supplying member for supplying the toner housed in the toner housing chamber to said toner-supporting member, said toner-supplying member being placed face to face with said toner-supporting member, the surface of said toner-supplying member and the surface of said toner-supporting member being allowed to move in opposite directions from each other at the face to face area;

the surface of the image-supporting member moving upwards from below at the developing area.

22. The image forming apparatus of claim 21, wherein the developing device comprises a charging blade and a regulating blade, the charging blade being placed in contact with the toner-supporting member and being positioned on a downstream side of the toner-supplying member with respect to the surface-moving direction of the toner-supporting member, the regulating blade being placed in contact with the toner-supporting member and being positioned on a downstream side of the charging blade with respect to the surface-moving direction of the toner-supporting member.

* * * * *

UNITED STATES PATENT AND TRADEMARK OFFICE

CERTIFICATE OF CORRECTION

PATENT NO. : 6,524,762 B2
DATED : February 25, 2003
INVENTOR(S) : Chikara Tsutsui et al.

It is certified that error appears in the above-identified patent and that said Letters Patent is hereby corrected as shown below:

Column 29,
Lines 25, 26, 30, 31 and 32, change “C.” to -- C --

Column 30,
Lines 12, 13, 17, 18 and 20, change “C.” to -- C --

Signed and Sealed this

Twenty-sixth Day of August, 2003

JAMES E. ROGAN
*Director of the United States Patent and Trademark Office*